US010586518B2

(12) United States Patent
Jalgha et al.

(10) Patent No.: US 10,586,518 B2
(45) Date of Patent: Mar. 10, 2020

(54) AUTOMATIC TUNING METHODS AND SYSTEMS

(71) Applicant: Band Industries, Inc., Port Townsend, WA (US)

(72) Inventors: Bassam Jalgha, Furn El Chebbak (LB); Hassane Slaibi, Rayak (LB)

(73) Assignee: Band Industries, Inc., Port Townsend, WA (US)

( * ) Notice: Subject to any disclaimer, the term of this patent is extended or adjusted under 35 U.S.C. 154(b) by 67 days.

(21) Appl. No.: 15/925,455

(22) Filed: Mar. 19, 2018

(65) Prior Publication Data

US 2018/0277069 A1 Sep. 27, 2018

Related U.S. Application Data

(60) Provisional application No. 62/477,392, filed on Mar. 27, 2017.

(51) Int. Cl.
*G10H 1/44* (2006.01)
*G10D 3/14* (2020.01)
(Continued)

(52) U.S. Cl.
CPC ..... *G10D 3/14* (2013.01); *G10G 7/00* (2013.01); *G10H 1/0008* (2013.01); *G10H 1/44* (2013.01);
(Continued)

(58) Field of Classification Search
CPC ..... G10H 1/44
(Continued)

(56) References Cited

U.S. PATENT DOCUMENTS 3,813,983 A * 6/1974 Paul ..... G10D 3/006 84/458
4,088,052 A * 5/1978 Hedrick ..... G10D 3/006 84/454
(Continued)

FOREIGN PATENT DOCUMENTS

CN 201117233 9/2008
KR 101035027 3/2010

OTHER PUBLICATIONS

Weibensteiner, et al., Motorized Guitar Tuner, Bachelor Thesis Telematics, Mar. 26, 2012, University of Technology, Graz, Austria.

*Primary Examiner* — David S Warren
(74) *Attorney, Agent, or Firm* — Ellenoff Grossman & Schole LLP; James M. Smedley; Alex Korona

(57) ABSTRACT

Embodiment apparatus and associated methods relate to adapting an actuator to adjust the tension of a musical instrument string, configuring a sensor to detect vibration propagated through the musical instrument body, configuring a noise removal filter to remove an undesired signal from vibration propagated through the musical instrument body, and automatically tuning the musical instrument based on adjusting the musical instrument string tension by the actuator while removing the undesired signal, until the fundamental frequency propagated through the instrument body by the vibration of the musical instrument string is within a predetermined tolerance of a reference frequency. In an illustrative example, the undesired signal may be actuator vibration. In some embodiments, actuator vibration spectral content may vary as a function of actuator torque, and, the noise removal filter may be adapted in real time. Various examples may advantageously provide faster and more accurate stringed musical instrument tuning.

35 Claims, 13 Drawing Sheets

(51) Int. Cl.
*G10H 3/22* (2006.01)
*G10H 1/00* (2006.01)
*G10G 7/00* (2006.01)

(52) U.S. Cl.
CPC ..... *G10H 3/22* (2013.01); *G10H 2220/005* (2013.01); *G10H 2220/021* (2013.01); *G10H 2230/015* (2013.01)

(58) Field of Classification Search
USPC ..... 84/454, 455
See application file for complete search history.

(56) References Cited

U.S. PATENT DOCUMENTS 4,365,537 A * 12/1982 Pogoda ..... G10D 3/163 84/320
4,523,506 A * 6/1985 Hollimon ..... G10G 7/02 324/76.57
4,889,029 A * 12/1989 St. Denis ..... G10D 3/006 84/454
4,899,636 A * 2/1990 Chiba ..... B06B 1/06 381/114
5,390,579 A * 2/1995 Burgon ..... G10D 3/14 84/454
5,528,970 A * 6/1996 Zacaroli ..... G10D 3/143 84/200
5,767,429 A * 6/1998 Milano ..... G10D 3/006 84/297 R
5,886,270 A * 3/1999 Wynn ..... G10D 3/14 84/313
5,990,403 A * 11/1999 Membreno ..... G10G 7/02 84/453
6,294,719 B1 * 9/2001 Palecki ..... G10D 3/006 81/124.2
6,437,226 B2 * 8/2002 Oudshoorn ..... G10D 3/14 84/454
6,465,723 B2 * 10/2002 Milano ..... G10D 3/006 84/274
6,784,353 B1 * 8/2004 Davis ..... G10D 3/14 84/312 R
6,870,084 B2 * 3/2005 Feiten ..... G10D 1/08 84/312 R
7,049,502 B2 * 5/2006 Taku ..... G10G 7/02 84/454
7,446,248 B2 * 11/2008 Skinn ..... G10D 3/143 84/312 R
7,659,466 B1 * 2/2010 Jang ..... G10D 3/006 84/304
8,253,002 B2 * 8/2012 Christmas ..... B25B 21/002 84/413
8,530,736 B2 * 9/2013 Liu ..... G10H 5/007 700/94
8,927,838 B2 * 1/2015 Jalgha ..... G10D 3/006 84/304
9,601,098 B2 * 3/2017 Black Hawk ..... G10G 7/00
2004/0182224 A1 * 9/2004 Catalano ..... G10G 7/02 84/454
2005/0045027 A1 * 3/2005 Celi ..... G10H 1/053 84/723
2005/0087060 A1 * 4/2005 Taku ..... G10G 7/02 84/455
2006/0101987 A1 * 5/2006 Celi ..... G10H 1/053 84/723
2010/0307322 A1 * 12/2010 Tominaga ..... G10H 5/007 84/622
2010/0313740 A1 * 12/2010 Ryle ..... G10H 1/053 84/735
2013/0213206 A1 * 8/2013 Jalgha ..... G10D 3/006 84/304
2015/0047493 A1 * 2/2015 Leadbetter ..... G10H 1/44 84/454
2016/0372097 A1 * 12/2016 Rogers ..... G10H 1/44
2017/0287458 A1 * 10/2017 Kaczynski ..... H03L 7/0991
2018/0277069 A1 * 9/2018 Jalgha ..... G10D 3/14
2018/0277083 A1 * 9/2018 Ruchert ..... G10G 7/02
2019/0180726 A1 * 6/2019 Shriki ..... G01G 7/02

* cited by examiner

AUTOMATIC TUNING METHODS AND SYSTEMS

CROSS-REFERENCE TO RELATED APPLICATIONS

This application claims the benefit of U.S. Provisional Application No. 62/477,392, entitled "AUTOMATIC TUNING METHODS AND SYSTEMS," filed on Mar. 27, 2017, the entire disclosure of which is hereby incorporated herein by reference.

TECHNICAL FIELD

Various embodiments relate generally to automatic tuning of stringed musical instruments.

BACKGROUND

Stringed musical instruments are musical instruments with strings that produce sound when the strings are plucked. Musical instrument strings may be suspended under tension. The tension of a musical instrument string affects the frequency of the sound produced when the string is plucked. Variation in musical instrument string tension results in changing the string frequency. Musical instrument string tension may be adjusted to a desired frequency in a procedure that may be known as tuning. A musician may spend a great deal of time and effort tuning a stringed instrument for a performance.

Some musicians tune their instruments in noisy environments. For example, musicians in a group may tune their instruments in the same location. Some tuning environments may include the sound of other nearby instruments undergoing tuning. The tuning of one instrument may be disrupted by the unwanted sound of other nearby instruments also being tuned at the same time. Some stringed musical instruments may have many strings. The different strings of a musical instrument may be tuned to various frequencies to facilitate musically and artistically advantageous frequency ranges and distributions. To facilitate increased musical agility in live performances, a musician may need to tune an instrument to various tunings during a performance or bring multiple pre-tuned instruments to a performance venue.

SUMMARY

Embodiment apparatus and associated methods relate to adapting an actuator to adjust the tension of a musical instrument string, configuring a sensor to detect vibration propagated through the musical instrument body, configuring a noise removal filter to remove an undesired signal from vibration propagated through the musical instrument body, and automatically tuning the musical instrument based on adjusting the musical instrument string tension by the actuator while removing the undesired signal, until the fundamental frequency propagated through the instrument body by the vibration of the musical instrument string is within a predetermined tolerance of a reference frequency. In an illustrative example, the undesired signal may be actuator vibration. In some embodiments, actuator vibration spectral content may vary as a function of actuator torque, and, the noise removal filter may be adapted in real time. Various examples may advantageously provide faster and more accurate stringed musical instrument tuning.

Various embodiments may achieve one or more advantages. For example, some embodiments may reduce the effort required to improve stringed musical instrument tuning quality. This facilitation may be a result of automatically tuning a musical instrument string based on vibration propagated through the instrument body. In some embodiments, more accurate tuning may be achieved in less time. Such faster and more accurate tuning may be a result of automatically tuning an instrument based on vibration propagated through the instrument body. In some examples, more accurate tuning may be achieved even in environments where nearby instruments are being tuned. Such increased noise tolerance when tuning may be a result of automatically tuning an instrument based on the instrument signal propagated to a contact sensor in mechanical contact with the instrument body. For example, the sound of nearby instruments being tuned may be sufficiently attenuated by use of a contact sensor to reduce the likelihood a nearby sound may interfere with tuning.

In some embodiments, faster tuning to customized tunings may be achieved by providing a user interface adapted to allow a musician to configure the frequency characteristics of each instrument string. In some embodiments, the time required to achieve an accurate tuning may be reduced. This facilitation may be a result of automatically adjusting the tension of a musical instrument string by an actuator while comparing the measured fundamental frequency of the string to a predetermined reference. In some embodiments, the effort required to maintain a stringed musical instrument may be improved. Such maintenance effort reduction may be a result of determining when strings need to be replaced based on string quality criteria determined as a function of the variation in string elasticity. String elasticity can be induced from the string tension, which is proportional to the fundamental frequency value being measured, and the elongation of the string, which is proportional to the rotation of the tuning peg. In some implementations, the accuracy of tuning may be improved. Such increased tuning accuracy may be a result of creating a musical instrument string model based on historical measurements of string fundamental frequency, string tension, and actuator torque, and providing the string model to a string evaluation process to generate predictive evaluations of tuning based on live measurements of string fundamental frequency, string tension, and actuator torque.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, an exemplary usage scenario of an embodiment stringed musical instrument tuner is briefly illustrated with reference to FIG. 1. Second, with reference to FIG. 2, the discussion turns to exemplary embodiments that illustrate the structure and design of an embodiment stringed musical instrument tuner. Third, with reference to FIG. 3, an illustrative process flow of an exemplary musical instrument tuner automatically adjusting the tension of musical instrument strings is disclosed. Then, with reference to FIG. 4, the design of an embodiment predictive musical instrument string data model is presented. Finally, with reference to FIGS. 5-9, illustrative examples disclose improvements to musical instrument tuning device design and construction.

Figure 1:
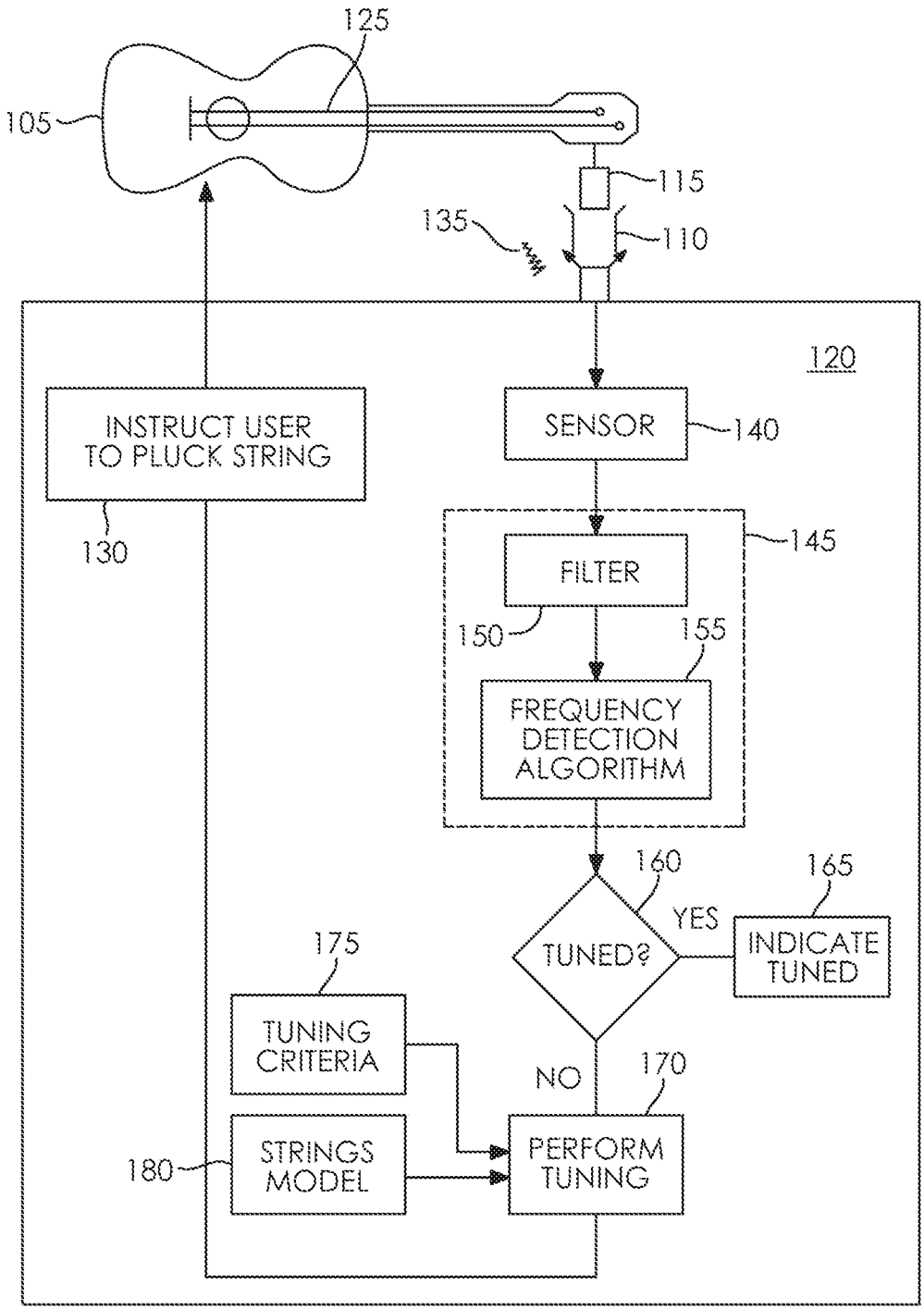
FIG. 1 depicts an exemplary usage scenario of an embodiment stringed musical instrument tuning device constructed based on adapting an actuator to adjust the tension of a musical instrument string, configuring a sensor to detect vibration propagated through the musical instrument body, configuring a noise removal filter to remove an undesired signal from vibration propagated through the musical instrument body, and automatically tuning the musical instrument based on adjusting the musical instrument string tension by the actuator while removing the undesired signal, until the fundamental frequency propagated through the instrument body by the vibration of the musical instrument string is within a predetermined tolerance of a reference frequency.

FIG. 1 depicts an exemplary usage scenario of an embodiment stringed musical instrument tuning device constructed based on adapting an actuator to adjust the tension of a musical instrument string, configuring a sensor to detect vibration propagated through the musical instrument body, configuring a noise removal filter to remove an undesired signal from vibration propagated through the musical instrument body, and automatically tuning the musical instrument based on adjusting the musical instrument string tension by the actuator while removing the undesired signal, until the fundamental frequency propagated through the instrument body by the vibration of the musical instrument string is within a predetermined tolerance of a reference frequency. In FIG. 1, the stringed musical instrument 105 is automatically tuned based on activating the actuator 110 to rotate the instrument tuning peg 115. In the depicted example, the tuning device 120 includes actuator 110 adapted to radially displace the tuning peg 115 releasably coupled with the actuator 110. In some embodiments, the actuator 110 may be driven by an attached motor governed by processor-executable program instructions configured to radially displace the tuning peg by a displacement predetermined as a function of one or more of: tension; frequency; or, position. In the illustrated embodiment, rotation of the tuning peg 115 results in a change in fundamental frequency of the string 125 being tuned. In the depicted embodiment, the user is prompted 130 to pluck string 125 to be tuned. In the illustrated example, the string vibration 135 is detected by the sensor 140. In some embodiments, the sensor 140 may be a vibration sensor. In various designs, the sensor 140 may be a vibration sensor in contact with the instrument 105 body. In some examples, the sensor 140 may be a piezoelectric sensor. In various implementations, the sensor 140 may be an accelerometer. In some embodiments, the sensor 140 may be a non-contact sensor. In an illustrative example, the sensor 140 may be a non-contact sensor such as a microphone. In some embodiments, the musical instrument 105 may be tuned based on sampling string vibration 135 propagated through the musical instrument 105 body and detected by sensor 140 in contact with the musical instrument 105 body. In some embodiments, more than one sensor 140 may be employed to detect vibration 135 of the instrument 105 and surrounding sound sources. In some embodiments, both a contact and non-contact sensor 140 may be employed to detect vibration 135 of the instrument 105 and surrounding sound sources. In some examples, a signal detected by more than one sensor 140 may be fused according to sensor fusion algorithms known in the art of sensor fusion. In some embodiments, one or more characteristic of sampled signal detected by one or more sensor 140 may be tracked according to tracking algorithms known in the art of audio signal processing. In the depicted embodiment, the vibration 135 detected by the sensor 140 is a vibration signal data package including a string 125 signal, one or more actuator 110 signal, and an external noise signal. In the illustrated embodiment, the string 125 signal, the one or more actuator 110 signal, and the external noise signal in the vibration signal data package propagate as vibration 135 to be detected by the sensor 140. In the illustrated embodiment, the sensor 140 is a piezoelectric sensor in contact with the instrument 105 body. In the illustrated example, the vibration signal data package is analyzed by the tuning device 120 using the signal processing module 145. In the depicted embodiment, the signal processing module 145 is configured with various computer-implemented signal processing algorithms as may be known in the art of audio signal processing. In the illustrated embodiment, the signal processing module 145 includes filter 150. In the depicted embodiment, the filter 150 is a configurable digital filter. In the illustrated embodiment, the signal processing module 145 includes frequency detection algorithm 155. In the illustrated embodiment, the filter 150 is adapted by tuning device 120 to remove the one or more actuator 110 signal from the vibration 135 signal data package received by the sensor 140. In some embodiments, the filter 150 may be an FIR (Finite Impulse Response) filter. In some embodiments, the tuning device 120 operation may include a training phase based on sampling active actuator 110 vibration 135 received by the sensor 140. In various designs the training phase may configure the filter 150 to remove the actuator 110 vibration 135. In various implementations, the filter 150 may be adapted to remove the external noise signal from the vibration 135 signal data package. In the depicted embodiment, the filter 150 substantially removes the actuator 110 signal from the vibration 135 signal data package, resulting in an approximation of the sampled vibration of the string 125 signal. In the depicted embodiment, at least one characteristic of the sampled vibration of the string 125 signal is estimated by at least one signal processing algorithm of signal processing module 145. In the illustrated embodiment, the at least one characteristic of the sampled vibration of the string 125 signal may be the fundamental frequency of the string 125 when plucked. In the depicted embodiment, the at least one signal processing algorithm includes a tuning algorithm. In the depicted embodiment, the exemplary tuning device 120 tuning algorithm automatically tunes the musical instrument 105 based on adjusting the musical instrument 105 string 125 tension by the actuator 110 while removing undesired signals, until the fundamental frequency propagated through the instrument 105 body by the vibration 135 of the musical instrument string 125 is within a predetermined tolerance of a reference frequency. In some embodiments, the tuning algorithm may fuse information from multiple sensors 140, to perform accurate and consistent tuning. In the illustrated example, the fundamental frequency of the string 125 signal is detected by frequency detection algorithm 155 and compared with a predetermined reference, to determine if the string 125 has been tuned based on the comparison. In the illustrated embodiment, upon a determination 160 the string 125 is tuned, an indication 165 the string has been tuned is provided. In the depicted example, upon a determination the string has not been tuned, tuning 170 is performed as a function of tuning criteria 175 and strings model 180. In an illustrative example, tuning may continue with prompting 130 the user to pluck a string 125 to tune.

Figure 2:
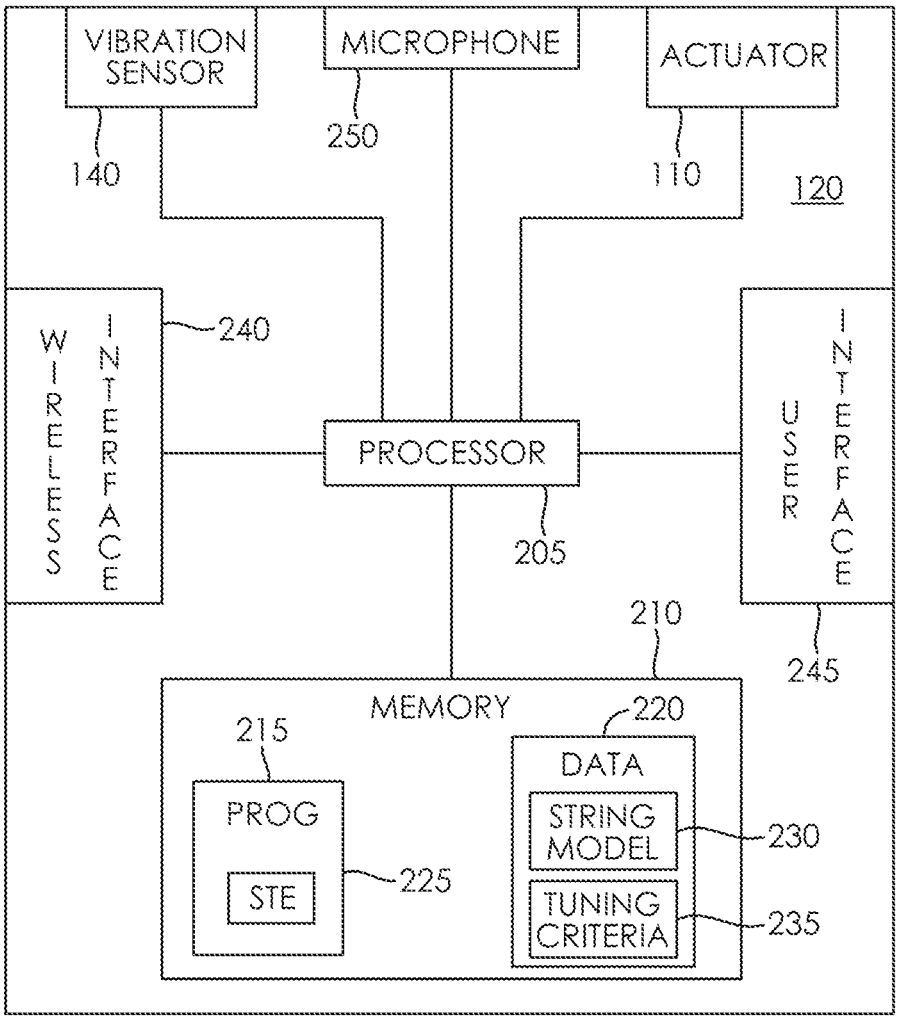
FIG. 2 depicts a structural overview of an embodiment stringed musical instrument tuning device.

FIG. 2 depicts a structural overview of an embodiment stringed musical instrument tuning device. In FIG. 2, an exemplary stringed musical instrument tuning device 120 includes processor 205 and memory 210. The depicted memory 210 includes program memory 215 and data memory 220. The depicted program memory 215 includes processor-executable program instructions configured to implement String Tuning Engine (STE) 225. The depicted data memory 220 includes processor-accessible data configured to implement String Model 230 and Tuning Criteria 235. In the illustrated example, the String Model 230 includes strings model 180, depicted in FIG. 1. In the depicted embodiment, the stringed musical instrument tuning device 120 includes wireless interface 240, user interface 245, vibration sensor 140, microphone 250, and actuator 110. The processor 205 is in electrical communication with the memory 210. In the depicted embodiment, the processor 205 is communicatively and operably coupled with the wireless interface 240, the user interface 245, the vibration sensor 140, and the microphone 250. In some embodiments, the microphone 250 may be omitted. In some implementations, the vibration sensor 140 may be omitted. Some embodiments may include the vibration sensor 140 and omit the microphone 250. In some embodiments, the vibration sensor 140 may be any contact sensor adaptable to detect vibration propagated through a vibrating body when in mechanical contact with the vibrating body. In some implementations, the microphone 250 may be any non-contact sensor adaptable to detect sound waves propagated in air. In various implementations, the wireless interface 240 may be replaced with a wireline interface. In some designs, the wireless interface 240 may be omitted. In various implementations, the user interface 245 may be adapted to receive input from a user or send output to a user. In some embodiments, the user interface 245 may be adapted to an input-only or output-only user interface mode. In some examples, the program memory 215 may include processor executable instructions executable by the processor 205 and adaptable to provide audio signal input capability, audio signal output capability, audio signal sampling, spectral analysis, correlation, autocorrelation, Fourier transforms, audio sample buffering, audio filtering operations including adjusting frequency response and attenuation characteristics of time domain and frequency domain filters, signal detection, or silence detection.

Figure 3A:
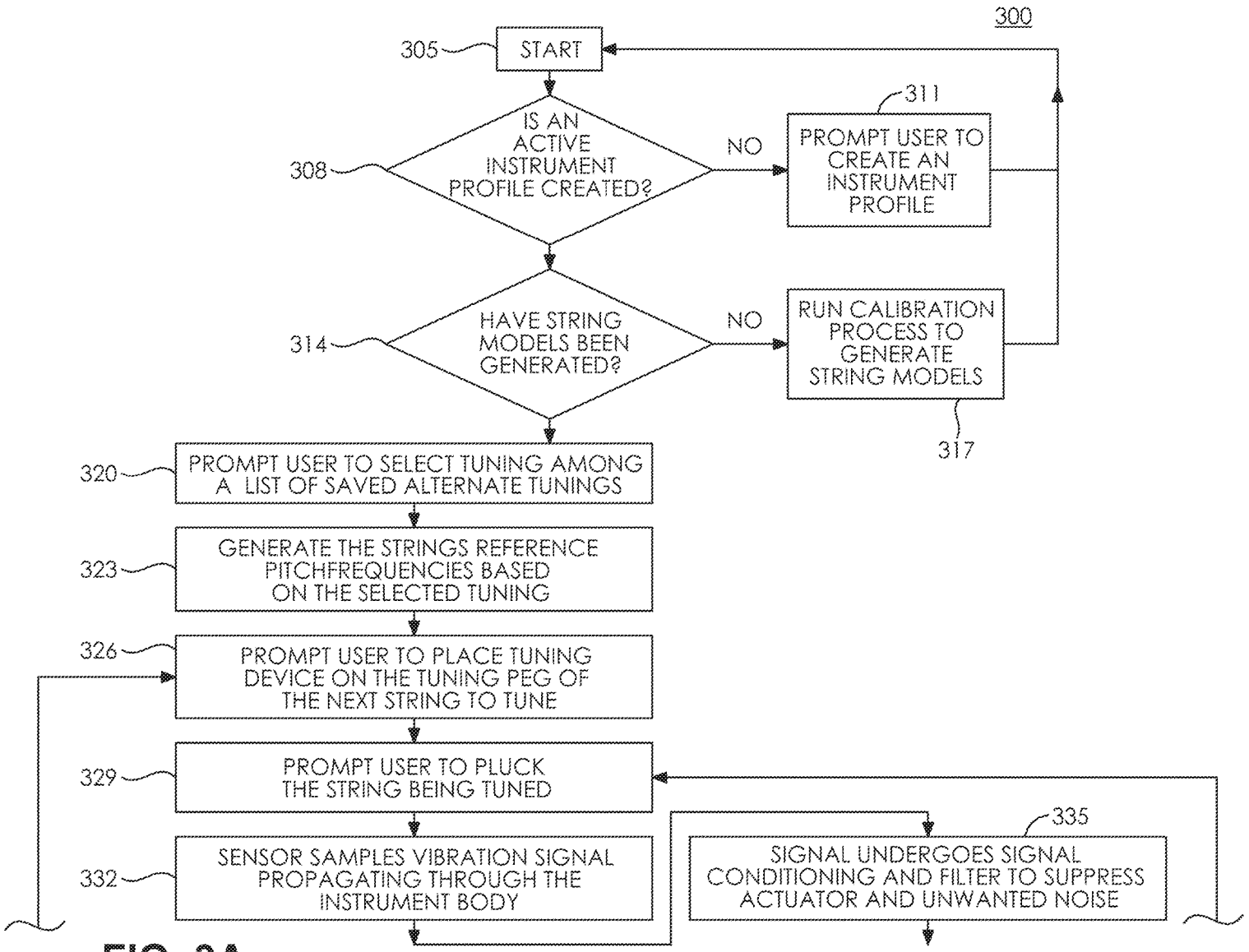
FIGS. 3A-3B together depict an illustrative process flow of an exemplary String Tuning Engine (STE).
Figure 3B:
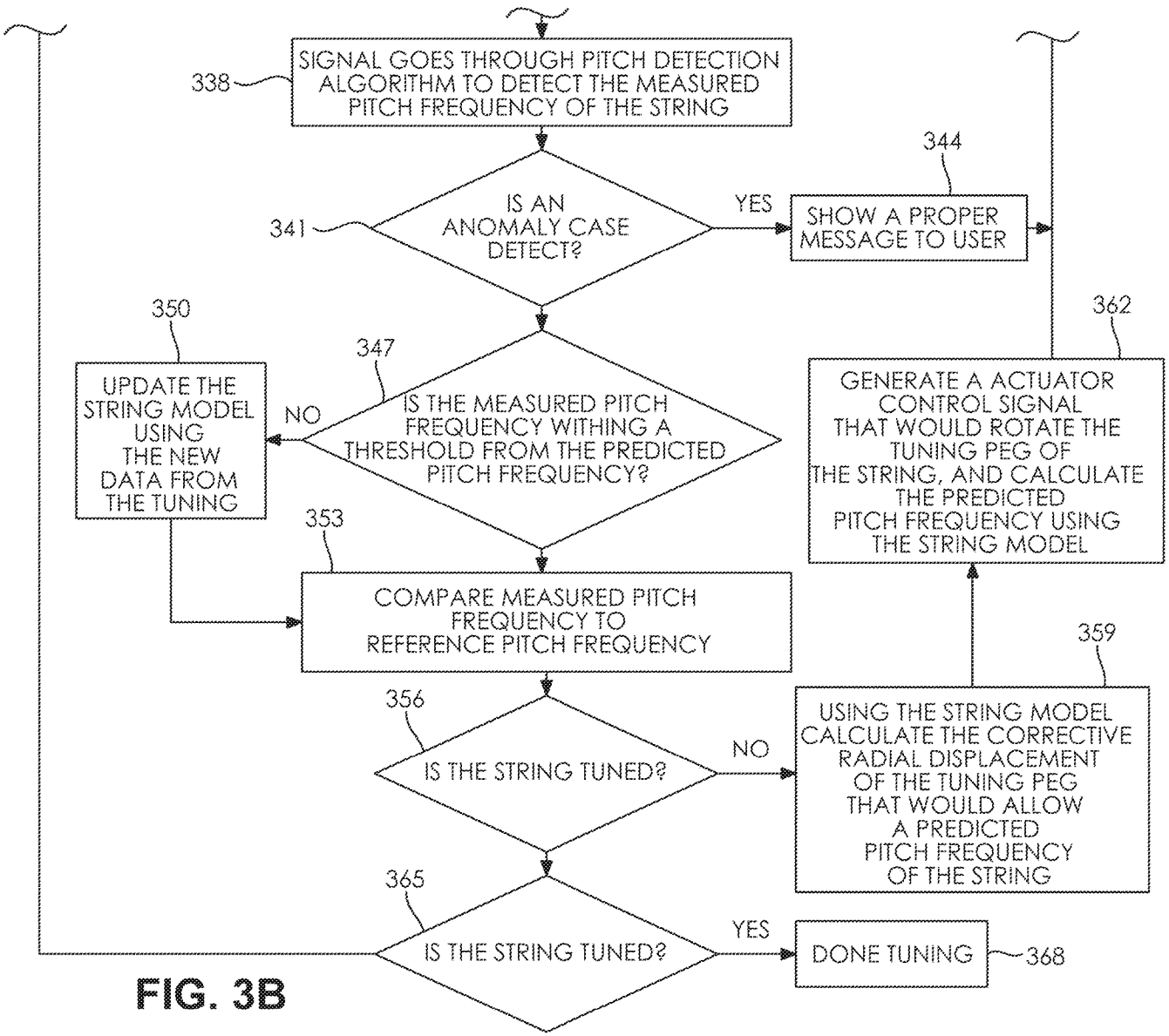

FIGS. 3A-3B together depict an illustrative process flow of an exemplary String Tuning Engine (STE). The method 300 depicted in FIGS. 3A-3B is given from the perspective of the String Tuning Engine (STE) 225, executing as program instructions on the processor 205 of the exemplary stringed musical instrument tuning device 120, depicted in FIGS. 1 & 2. In some embodiments, the String Tuning Engine (STE) 225 may execute as a cloud service governed by the processor 205 and communicatively coupled with system services, hardware resources, or software elements local to and/or external to the stringed musical instrument tuning device 120. The depicted method 300 begins at step 305 with the processor 205 determining at step 308 if an active instrument profile has been created. Upon a determination by the processor 205 at step 308 that an active instrument profile has not been created, the method continues at step 311 with the processor 205 prompting the user to create an instrument profile, and the method continues at step 305 with the processor 205 determining if an active instrument profile has been created. Upon a determination by the processor 205 at step 308 that an active instrument profile has been created, the method continues at step 314 with the processor 205 determining if string models 230 have been generated. Upon a determination by the processor 205 at step 314 that a string model 230 has not been generated, the method continues at step 317 with the processor 205 executing a calibration process to generate one or more string model 230. Upon a determination at step 314 by the processor 205 that a string model 230 has been generated, the method continues at step 320 with the processor 205 prompting the user to select a tuning among a list of saved alternate tunings. The method continues at step 323 with the processor 205 generating the strings reference pitch frequencies based on the selected tuning. The method continues at step 326 with the processor 205 prompting the user to place the tuning device 120 on the tuning peg 115 of the next string 125 to tune. The method continues at step 329 with the processor 205 prompting the user to pluck the string 125 being tuned. The method continues at step 332 with the processor 205 sampling a vibration 135 signal propagating through the instrument 105 body to the sensor 140. The method continues at step 335 with the processor 205 conditioning and filtering the vibration 135 signal to suppress actuator 110 vibration and unwanted noise. The method continues at step 338 with the processor 205 detecting pitch and measured pitch frequency of the string. The method continues at step 341 with the processor 205 performing a test to determine if an anomaly case has been detected as a function of the pitch frequency of the string 125 measured by the pitch detection algorithm 155. Upon a determination by the processor 205 at step 341 that an anomaly case has been detected, the method continues at step 344 with the processor 205 providing an indication of the anomaly to the user, and the method continues at step 329 with the processor 205 prompting the user to pluck the string 125 being tuned. For example, the user may be warned to take proper action in the following cases, before risking damage to a string: device placed on wrong tuning peg; user plucked wrong string; or, string is wound on peg in opposite direction. In some embodiments, the processor 205 may employ a data model 230 of the string being tuned, to predict, by the processor 205, the pitch frequency of the string 125. Upon a determination at step 341 by the processor 205 an anomaly case has not been detected, the processor 205 compares at step 347 the measured pitch frequency with the predicted pitch frequency, to determine if the measured pitch frequency is within a predetermined threshold from the predicted pitch frequency, based on the comparison. Upon a determination at step 347 by the processor 205 that the measured pitch frequency is not within a predetermined threshold from the predicted pitch frequency, the method continues at step 350 with the processor 205 updating the string model using the new data from the tuning. The method continues at step 353 with the processor 205 comparing the measured pitch frequency to a predetermined reference pitch frequency, to determine if the string has been tuned, based on the comparison, and the method continues at step 356. Upon a determination by the processor at step 356 the string has not been tuned based on the comparison by the processor 205 at step 353, the method continues at step 359 with the processor 205 calculating the corrective radial displacement, determined as a function of the string model 230, that would allow a predicted pitch frequency to reach the predetermined reference pitch frequency of the string 125. The method continues at step 362 with the processor 205 generating an actuator 110 control signal that would rotate the tuning peg 115 of the string 125, and the processor 205 calculates the new predicted pitch frequency as a function of the string model 230. The method continues at step 329 with the processor 205 prompting the user to pluck the string 125 being tuned. Upon a determination at step 356 by the processor 205 the string 125 has been tuned, the method continues at step 365 with the processor 205 determining if all strings have been tuned. Upon a determination at step 365 by the processor 205 all strings have been tuned, the method continues at step 368 with the processor 205 indicating tuning complete. Upon a determination by the processor 205 at step 365 all strings have not been tuned, the method continues at step 326 with the processor 205 prompting the user to place the tuning device 120 on the tuning peg 115 of the next string 125 to tune.

Figure 4:
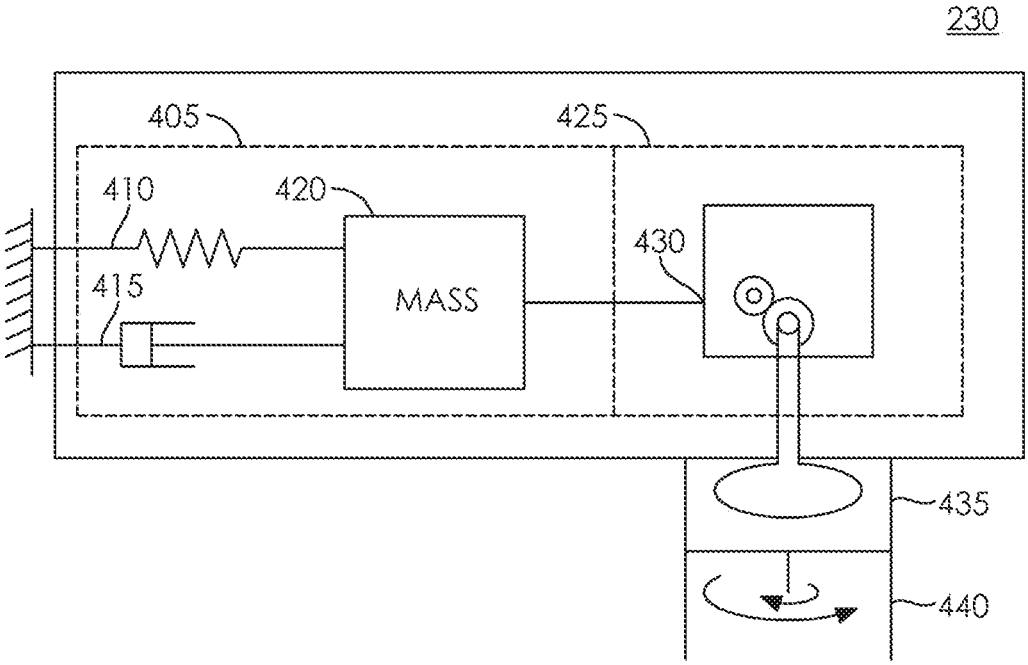
FIG. 4 depicts an embodiment predictive data model representative of an exemplary musical instrument string.

FIG. 4 depicts an embodiment predictive data model representative of an exemplary musical instrument string. In some embodiments, the musical instrument string model 230 depicted in FIG. 4 may be implemented as data accessible to processor 205 in data memory 220, depicted in FIG. 2. In the embodiment depicted in FIG. 4, the musical instrument string model 230 includes predictive string model 405. In the illustrated embodiment, the predictive string model 405 includes mass model 420, spring model 410 (representing elasticity), and damper model 415 (representing friction). In the depicted embodiment, the musical instrument string model 230 also includes predictive tuning peg gearbox model 425. In the illustrated embodiment, the tuning peg gearbox model 425 includes gear model 430 (to represent gear ratio and backlash in gears), tuning peg model 435, and actuator model 440. In some embodiments, the depicted musical instrument string model 230 may be used to create a relation between pitch frequency and tuning peg 115 rotation angle. In some embodiments, based on creating a relationship between the measured rotation of the actuator 110 and tuning peg 115 to the string 125 frequency, the tuning device 120 may build the model 230 of the strings and instruments being tuned. In various examples, data retained within the depicted musical instrument string model 230 may be fused with user input and tuning history information to track the string 125 quality and inform the user when it is time to restring. In some embodiments, the string model 230 may include historical data. In some embodiments, the string model 230 may include time-stamped sampled data. Some string model designs may be configured as baseline or reference models representing a specific model or style of string. In various implementations, the string model 230 may be hosted by a cloud server.

Figure 5:
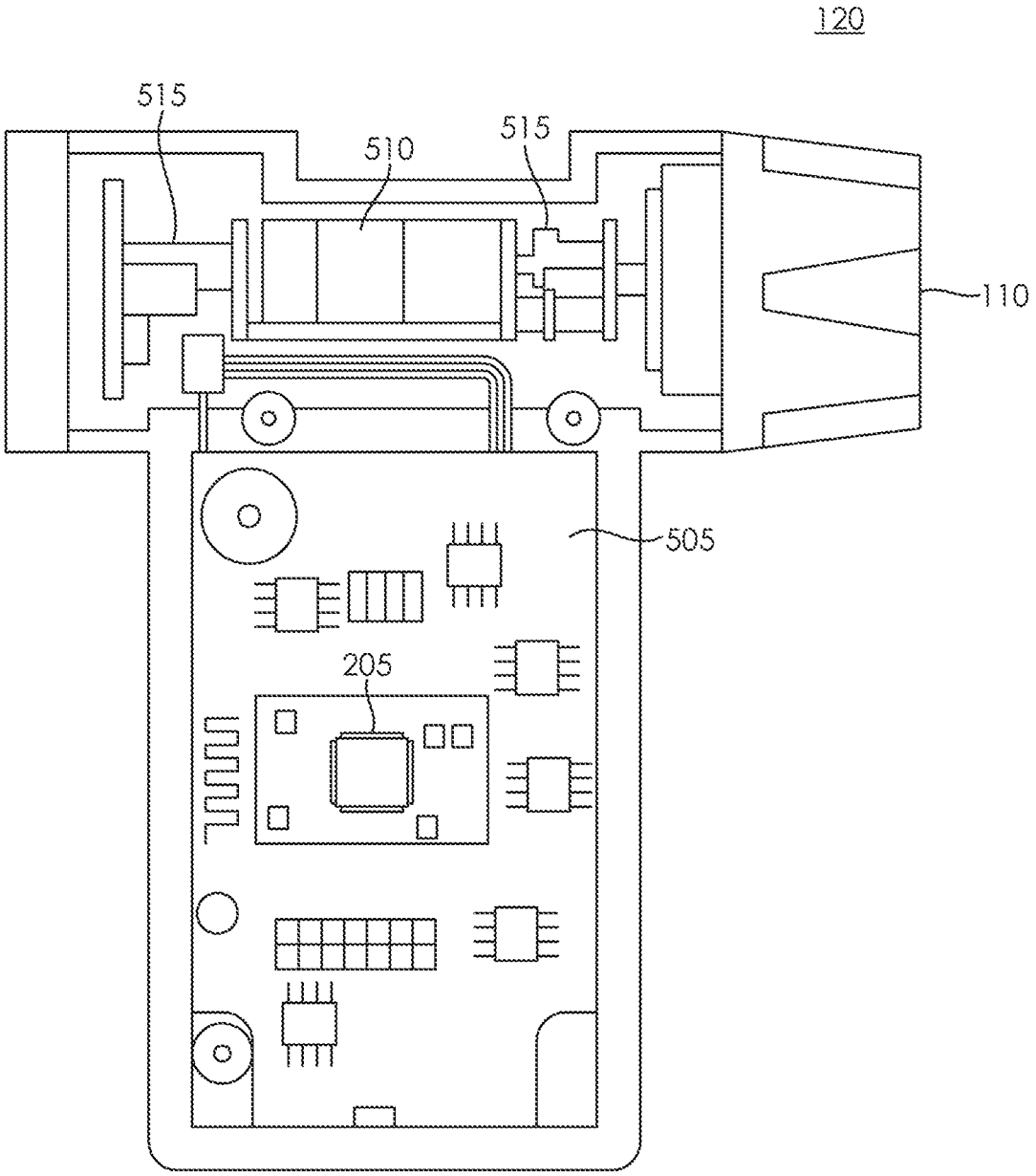
FIG. 5 depicts a component view of an exemplary stringed musical instrument tuning device.

FIG. 5 depicts a component view of an exemplary stringed musical instrument tuning device. In FIG. 5, the exemplary musical instrument tuning device 120 is depicted partially disassembled to display an illustrative interior portion of the tuning device 120. In the depicted embodiment, the processor 205 is electrically coupled with related components disposed on the tuning device 120 control module 505. In the illustrated embodiment, the actuator 110 is operably coupled to the processor 205 via the motor 510 and the gearbox drive mechanism 515.

Figure 6:
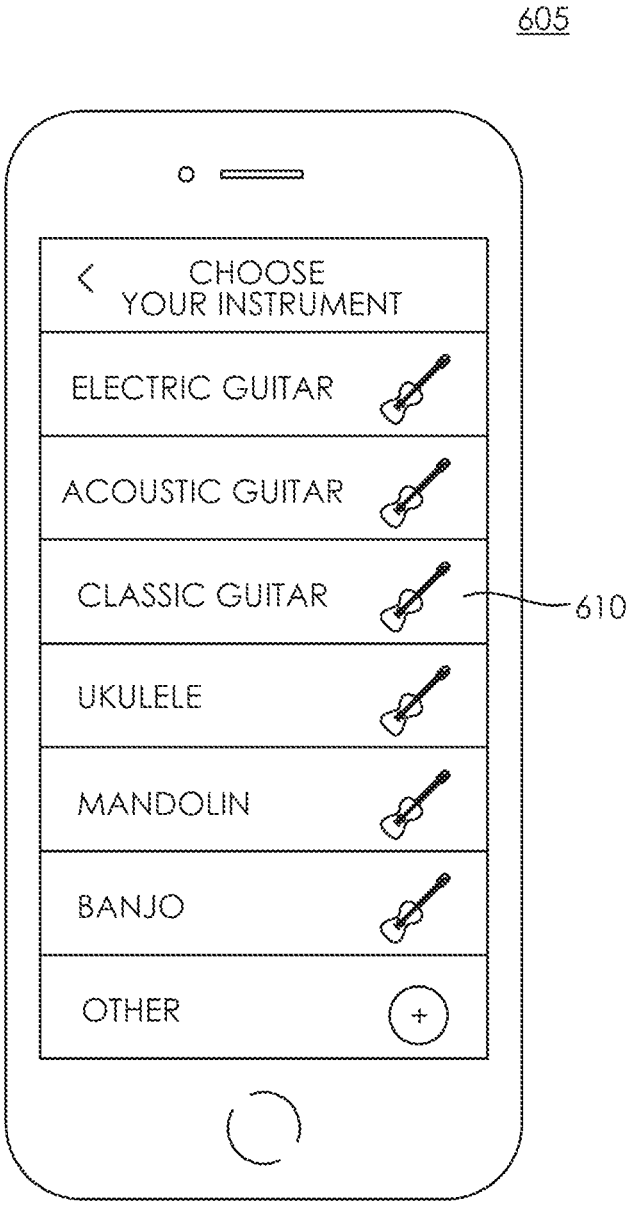
FIG. 6 depicts a screenshot view of an exemplary stringed musical instrument tuning device mobile application usage scenario.

FIG. 6 depicts a screenshot view of an exemplary stringed musical instrument tuning device mobile application usage scenario. In FIG. 6, an exemplary mobile device application 605 instrument type selection screen menu is depicted in use to select a type of instrument to be tuned by exemplary musical instrument tuning device 120. In the illustrated example, several musical instrument profiles are displayed to the user by the mobile device application 605, including Electric Guitar, Acoustic Guitar, Classical Guitar, Ukulele, Mandolin, Banjo, and Other. In the depicted example, the user may enter a custom musical instrument profile by selecting Other. In the depicted example, Classical Guitar is the user's selected profile 610.

Figure 7:
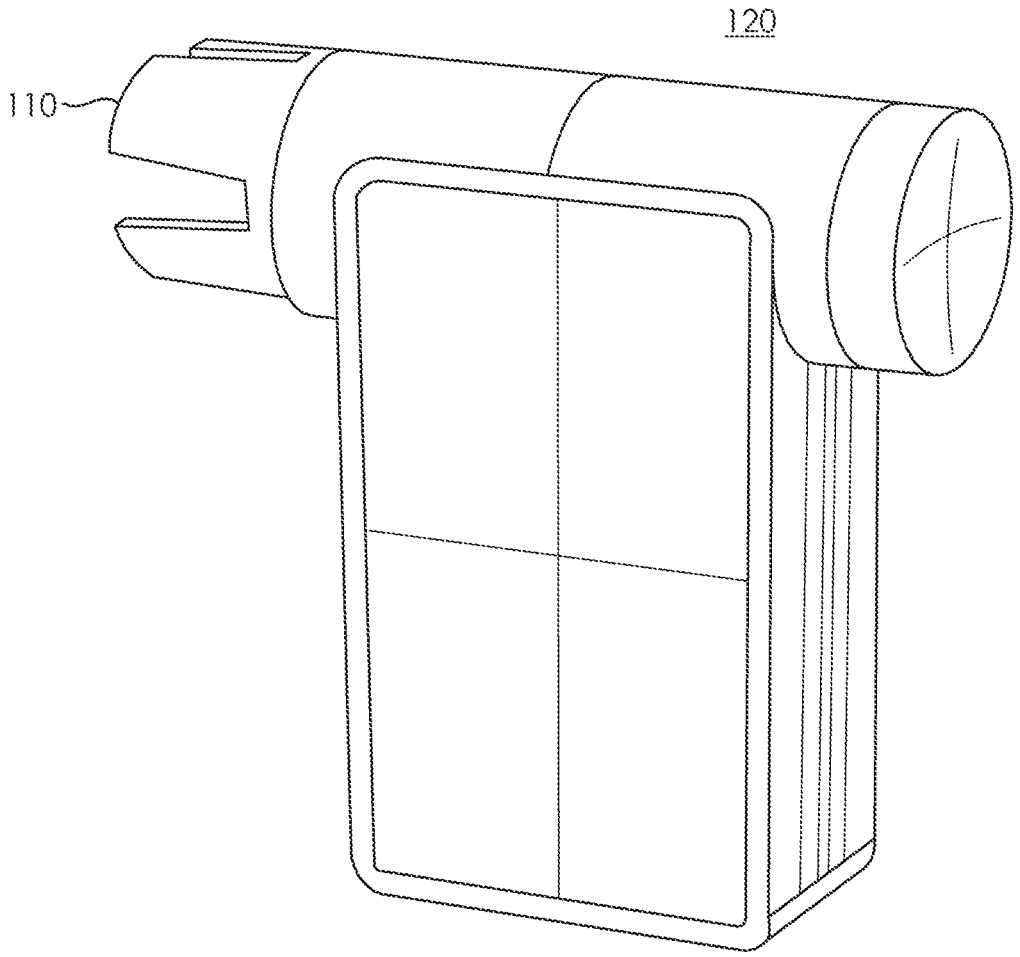
FIG. 7 is a perspective view depicting an exemplary stringed musical instrument tuning device.

FIG. 7 is a perspective view depicting an exemplary stringed musical instrument tuning device. In FIG. 7, the stringed musical instrument tuning device 120 is depicted fully assembled with actuator 110 slots longitudinally disposed within the actuator end effector outer circumference.

Figure 8:
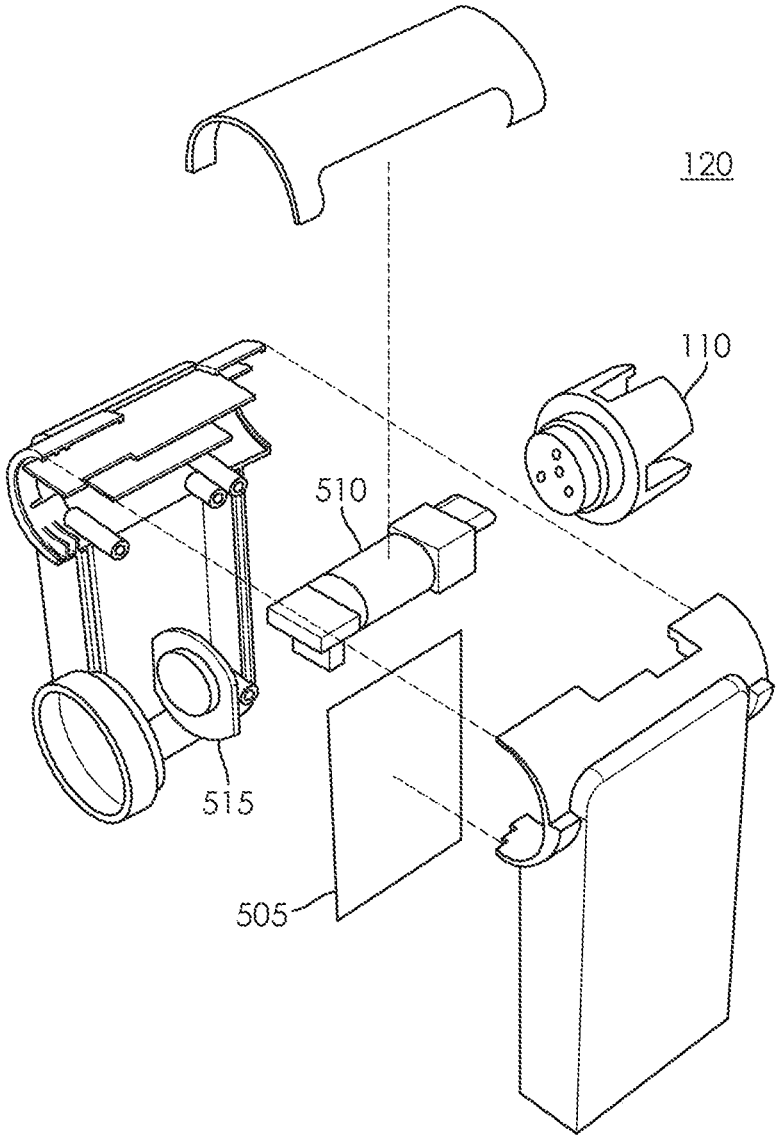
FIG. 8 is an exploded view depicting an exemplary stringed musical instrument tuning device.

FIG. 8 is an exploded view depicting an exemplary stringed musical instrument tuning device. In FIG. 8, the construction of an exemplary musical instrument tuning device 120 from the various component parts is depicted. In the illustrated embodiment, the depicted musical instrument tuning device 120 may be constructed based on the illustrated relationships between the control module 505, actuator 110, motor 510, and gearbox drive mechanism 515.

FIGS. 9A-9L depict exemplary screenshot views illustrative of embodiment stringed musical instrument tuning device user interfaces. The embodiment stringed musical instrument tuning device 120 includes user interface 245, also depicted in FIG. 2. In some embodiments, the exemplary stringed musical instrument tuning device 120 user interfaces 245 depicted in FIGS. 9A-9L may be implemented as a software application executing on a mobile device operably coupled with the tuning device 120. In various implementations, the mobile device may be operably coupled with the tuning device 120 via one or more wireless interface 240, depicted in FIG. 2. In various embodiments, the exemplary stringed musical instrument tuning device 120 user interfaces 245 depicted in FIGS. 9A-9L may be implemented as a physical user interface configured in the stringed musical instrument tuning device 120. In various implementations, the physical user interface configured in the stringed musical instrument tuning device 120 may be configured to accept user input.

Figure 9A:
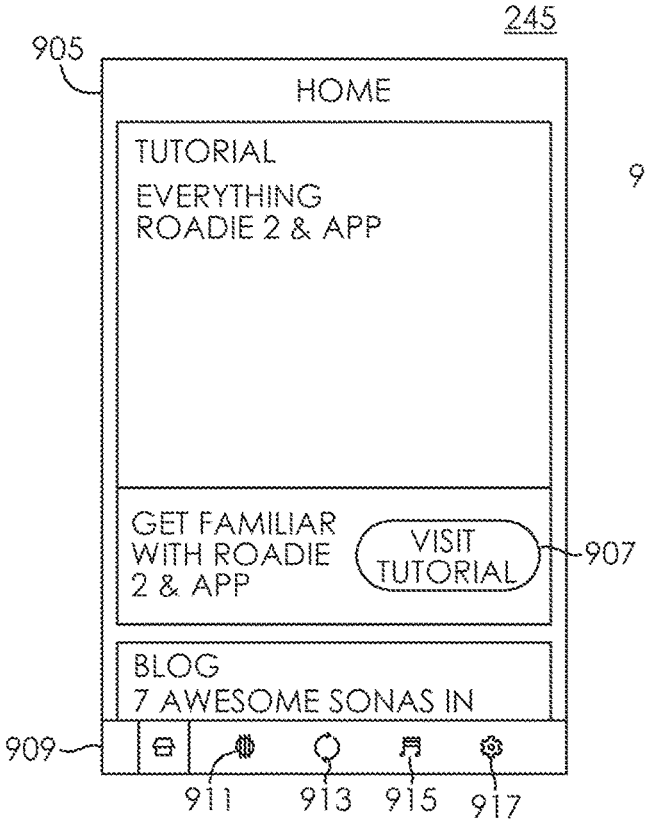
FIGS. 9A-9L depict exemplary screenshot views illustrative of embodiment stringed musical instrument tuning device user interfaces.

In FIG. 9A, an exemplary stringed musical instrument tuning device 120 user interface 245 home screen 905 is depicted presenting options to a user. In the depicted embodiment, the stringed musical instrument tuning device 120 user interface 245 is a mobile device application user interface. In the illustrated embodiment, from the stringed musical instrument tuning device 120 user interface 245 home screen 905, the user may select the Visit Tutorial button 907 to begin an informative educational presentation designed to assist the user with operation of the tuning device 120. In the depicted embodiment, the user may select the Home button 909 to return the user interface 245 current focus screen to the home screen 905. In the illustrated embodiment, the user may select the Instruments button 911 to transition the user interface 245 focus to an Instruments menu. In the depicted embodiment, the user may select the Sync button 913 to cause the user interface 245 to synchronize the tuning device 120 with data remote from the tuning device 120. In the illustrated embodiment, the user may select the Tunings button 915 to transition the user interface 245 focus to a Tunings menu. In the depicted embodiment, the user may select the Settings button 917 to transition the user interface 245 focus to a Settings menu.

Figure 9B:
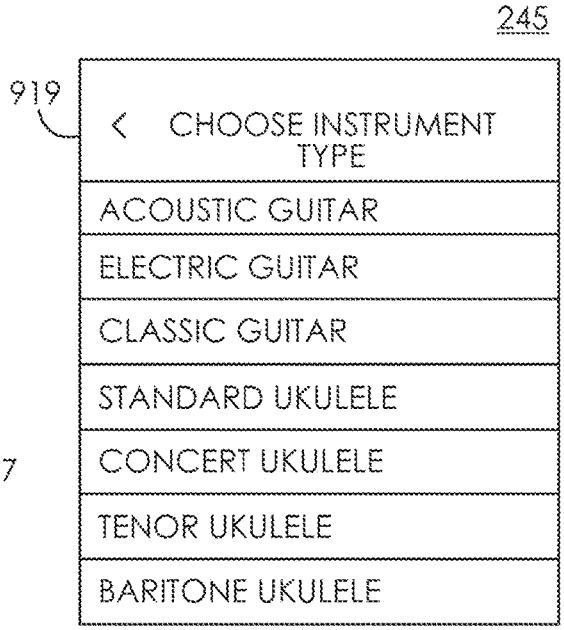

In FIG. 9B, an exemplary stringed musical instrument tuning device 120 user interface 245 Instrument Type Selection screen 919 is depicted presenting options to a user. In the depicted embodiment, the stringed musical instrument tuning device 120 user interface 245 is a mobile device application user interface. In the illustrated embodiment, from the stringed musical instrument tuning device 120 user interface 245 Instrument Type Selection screen 919, the user may select from various instrument types, including Acoustic Guitar, Electric Guitar, Classical Guitar, Standard Ukulele, Concert Ukulele, Tenor Ukulele, and Baritone Ukulele. In the depicted embodiment, the user has selected Acoustic Guitar as the instrument type chosen on stringed musical instrument tuning device 120 user interface 245 Instrument Type Selection screen 919.

Figure 9C:
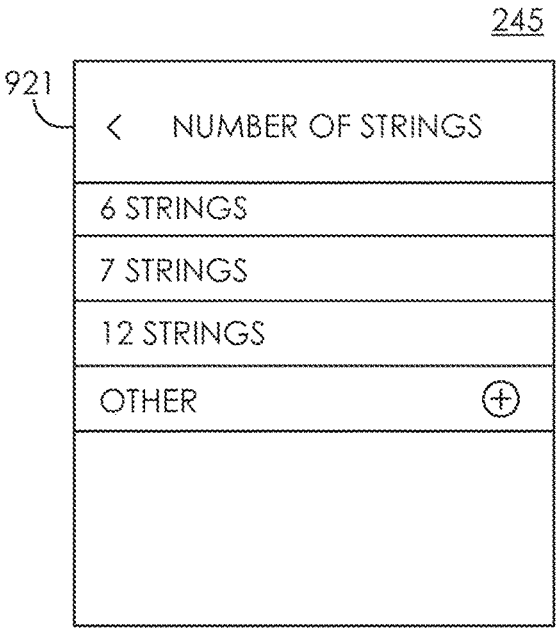

In FIG. 9C, an exemplary stringed musical instrument tuning device 120 user interface 245 Number of Strings Selection screen 921 is depicted presenting options to a user. In the depicted embodiment, the stringed musical instrument tuning device 120 user interface 245 is a mobile device application user interface. In the illustrated embodiment, from the stringed musical instrument tuning device 120 user interface 245 Number of Strings Selection screen 921, the user may select from various instrument string number configurations, including 6 Strings, 7 Strings, 12 Strings, and Other. In some embodiments, the user may create a custom string number configuration by selecting Other.

Figure 9D:
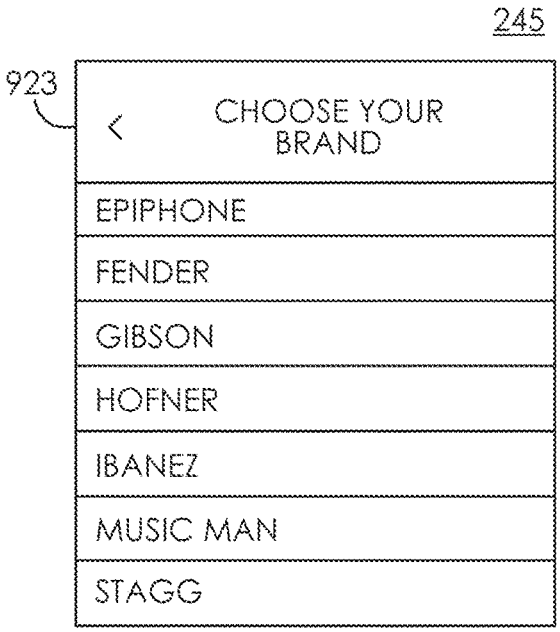

In FIG. 9D, an exemplary stringed musical instrument tuning device 120 user interface 245 Brand Selection screen 923 is depicted presenting options to a user. In the depicted embodiment, the stringed musical instrument tuning device 120 user interface 245 is a mobile device application user interface. In the illustrated embodiment, from the stringed musical instrument tuning device 120 user interface 245 Brand Selection screen 923, the user may select from various instrument Brands, including Epiphone, Fender, Gibson, Hofner, Ibanez, Music Man, and Stagg.

Figure 9E:
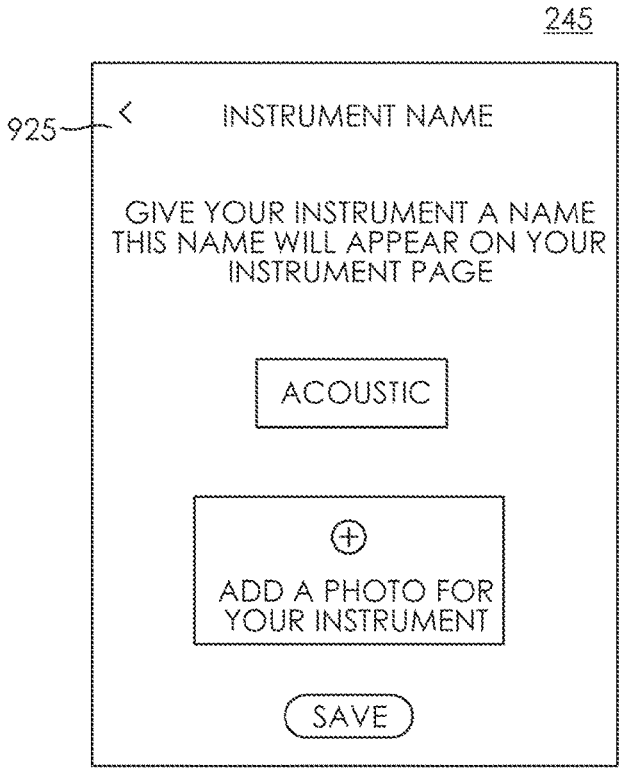

In FIG. 9E, an exemplary stringed musical instrument tuning device 120 user interface 245 Instrument Name Configuration screen 925 is depicted presenting options to a user. In the depicted embodiment, the stringed musical instrument tuning device 120 user interface 245 is a mobile device application user interface. In the illustrated embodiment, from the stringed musical instrument tuning device 120 user interface 245 Instrument Name Configuration screen 925, the user may configure the name of their instrument to appear on their instrument page. In the depicted embodiment, the user may add a picture of the instrument. In the illustrated example, the user has configured the instrument name Acoustic.

Figure 9F:
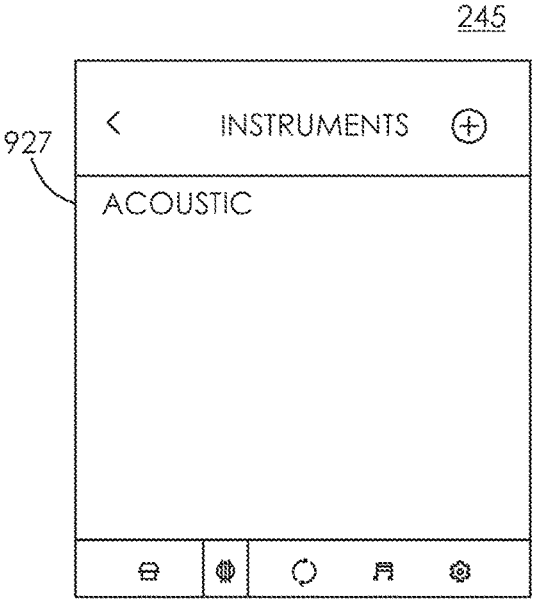

In FIG. 9F, an exemplary stringed musical instrument tuning device 120 user interface 245 Instruments screen 927 is depicted presenting a list of configured instruments to a user. In the depicted embodiment, the stringed musical instrument tuning device 120 user interface 245 is a mobile device application user interface. In the illustrated embodiment, the stringed musical instrument tuning device 120 user interface 245 Instruments screen 927 displays the Acoustic instrument named in FIG. 9E.

Figure 9G:
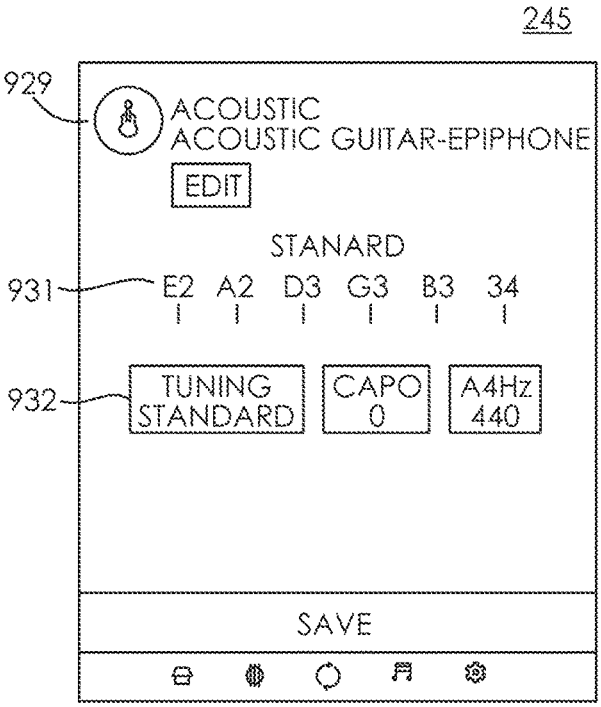

In FIG. 9G, an exemplary stringed musical instrument tuning device 120 user interface 245 Tuning Configurations screen 929 is depicted presenting options to a user. In the depicted embodiment, the stringed musical instrument tuning device 120 user interface 245 is a mobile device application user interface. In the illustrated embodiment, from the stringed musical instrument tuning device 120 user interface 245 Tuning Configurations screen 929, the user may choose a tuning configuration for their instrument. In the depicted embodiment, the user may select from Standard Tunings 931 including E2, A2, D3, G3, B3, and E4. In the depicted example, the user may select Custom Tuning Features 932 including Capo position and Tuning Frequency. In the illustrated example, the user has selected Standard Tuning for the configured Epiphone Acoustic Guitar named Acoustic. In the depicted embodiment, the user has selected Capo position zero. In the illustrated embodiment, the user has selected a tuning reference frequency of 440 Hz. In the depicted embodiment, the user may store the configured tuning by selecting the save button.

Figure 9H:
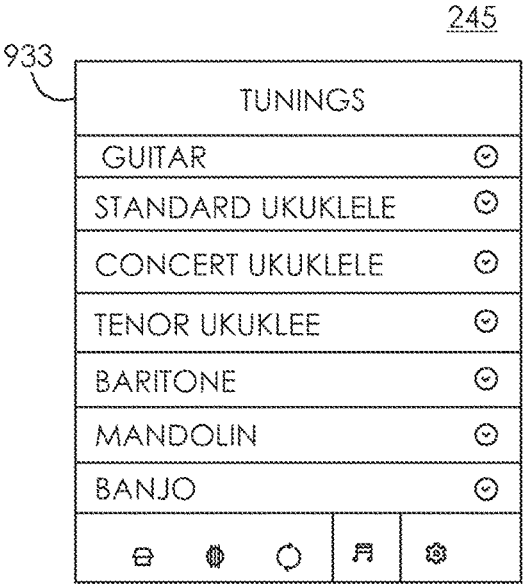

In FIG. 9H, an exemplary stringed musical instrument tuning device 120 user interface 245 Tunings Selection screen 933 is depicted presenting options to a user. In the depicted embodiment, the stringed musical instrument tuning device 120 user interface 245 is a mobile device application user interface. In the illustrated embodiment, from the stringed musical instrument tuning device 120 user interface 245 Tunings Selection screen 933, the user may select from various instrument tunings organized based on Instrument Type, including Guitar, Standard Ukulele, Concert Ukulele, Tenor Ukulele, Baritone Ukulele, Mandolin, and Banjo.

Figure 9I:
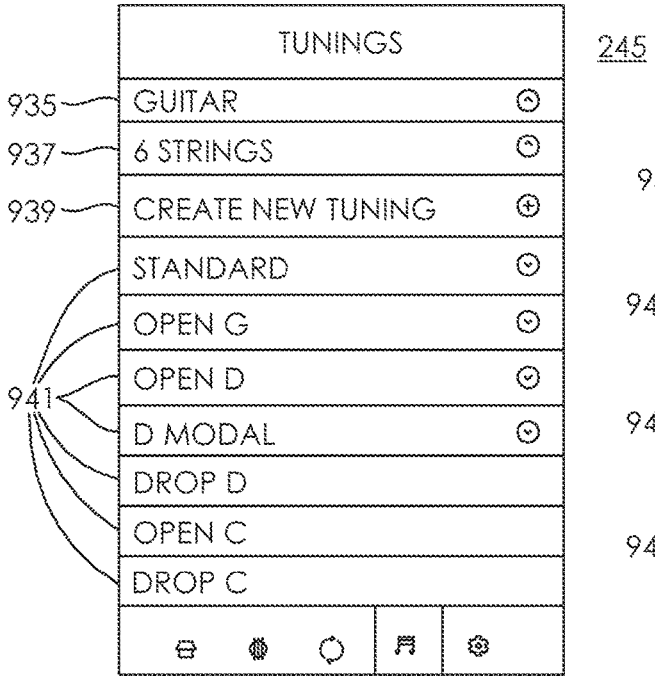

In FIG. 9I, an exemplary stringed musical instrument tuning device 120 user interface 245 Tunings screen 935 is depicted presenting tuning customization options to a user based on the selected Instrument Type. In the depicted embodiment, the stringed musical instrument tuning device 120 user interface 245 is a mobile device application user interface. In the illustrated embodiment, the user has selected Guitar as the Instrument Type. In the illustrated embodiment, from the stringed musical instrument tuning device 120 user interface 245 Tunings screen 935, the user may select the Number of Strings 937. In the depicted embodiment, the user has selected 6 Strings as the Number of Strings 937 for the selected Guitar Instrument Type. In the illustrated embodiment, from the stringed musical instrument tuning device 120 user interface 245 Tunings screen 935, the user may select Create New Tuning 939 to configure a new tuning. In the depicted embodiment, from the stringed musical instrument tuning device 120 user interface 245 Tunings screen 935, the user may select the Tuning Type 941 from various preconfigured tuning configurations including Standard, Open G, Open D, D Modal, Drop D, Open C, and Drop C.

Figure 9J:
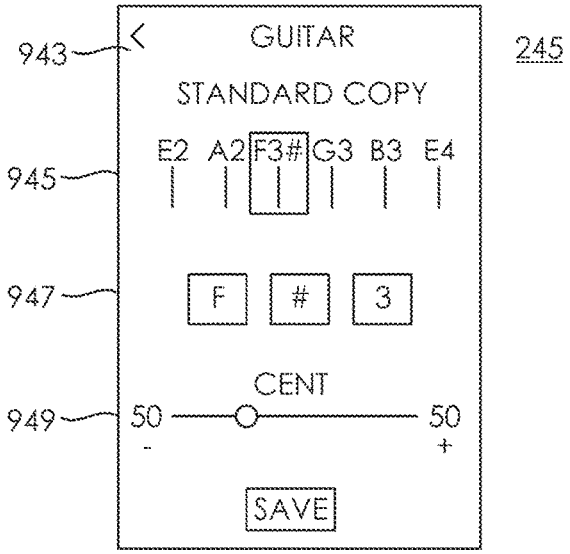

In FIG. 9J, an exemplary stringed musical instrument tuning device 120 user interface 245 Tuning Configuration screen 943 is depicted presenting a user with tuning customization options based on the selected Instrument Type. In the depicted embodiment, the stringed musical instrument tuning device 120 user interface 245 is a mobile device application user interface. In the illustrated embodiment, the user has selected Guitar as the Instrument Type. In the depicted embodiment, from the stringed musical instrument tuning device 120 user interface 245 Tuning Configuration screen 943, the user may select a tuning configuration 945 to be customized. In the depicted embodiment, the user has selected F3#, −19 cent as the tuning configuration 945 to be customized. In the illustrated embodiment, the Tuning Configuration screen 943 presents a user with Tuning Parameters 947 options to customize the Guitar tuning. In the depicted embodiment, the user has selected F #3 as the customized Guitar Tuning Parameters 947. In the illustrated embodiment, the Tuning Configuration screen 943 provides the user with the capability to customize their instrument's tuning by adjusting the tuning frequency with the Variable Tuning Frequency Control 949. In the depicted embodiment, the Variable Tuning Frequency Control 949 is illustrated as a slider implementing user control of Cents in the range −/+50 Cents. In some embodiments, the Variable Tuning Frequency Control 949 may be any graphic or non-graphic control with any useful range of effect. In the depicted example, the Variable Tuning Frequency Control 949 is set to 182.98 Hz, however the Variable Tuning Frequency Control 949 may in some embodiments be set to any useful value within an effective range as would be known to those of ordinary skill in the arts related to musical instrument tuning. In the depicted embodiment, the user may store the configured tuning by selecting the save button.

Figure 9K:
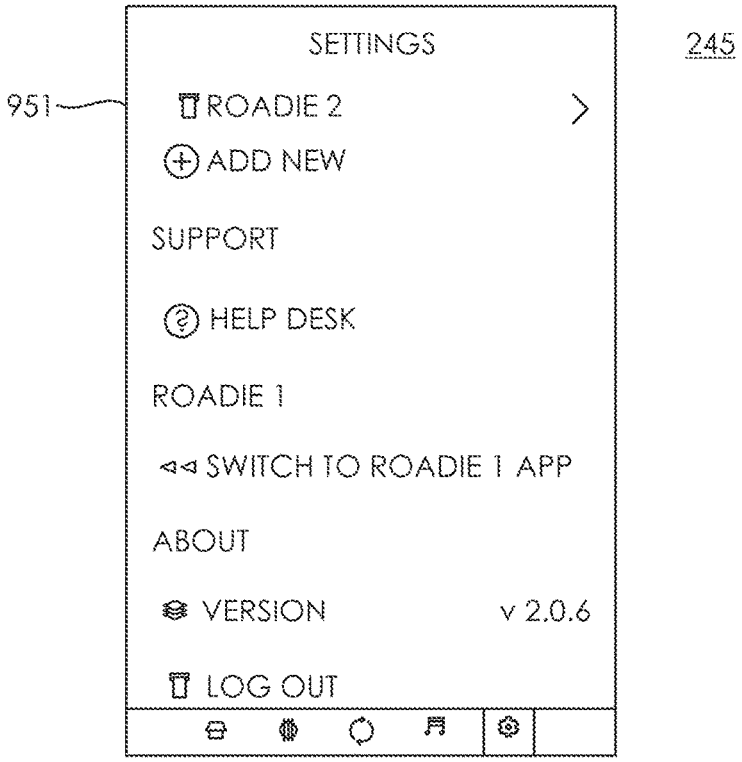

In FIG. 9K, an exemplary stringed musical instrument tuning device 120 user interface 245 Settings screen 951 is depicted presenting options to a user. In the depicted embodiment, the stringed musical instrument tuning device 120 user interface 245 is a mobile device application user interface. In the illustrated embodiment, from the stringed musical instrument tuning device 120 user interface 245 Settings screen 951, the user may select from various musical instrument tuning device 120 options including: Roadie2, to configure the settings of the stringed musical instrument tuning device 120; Add New, to add or configure a new stringed musical instrument tuning device 120 with the same instruments and tunings, for example, the user may select Add New to facilitate configuration of multiple Roadie 2 devices through the same application; Help Desk, to invoke support features; Switch to Roadie 1 App, to activate the Roadie 1 app; and, Log out, to end the user's stringed musical instrument tuning device 120 login session.

Figure 9L:
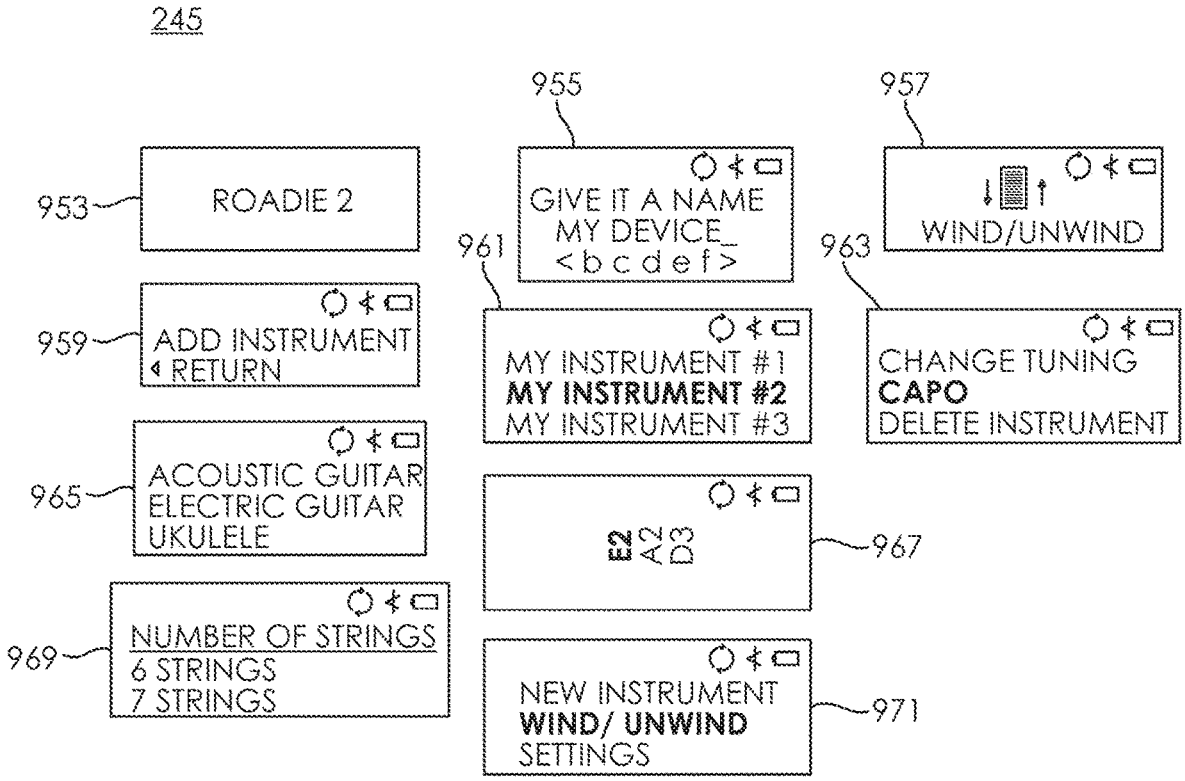

In FIG. 9L, an exemplary stringed musical instrument tuning device 120 user interface 245 is depicted implemented as a physical user interface configured in the stringed musical instrument tuning device 120. In the illustrated embodiment, the physical user interface configured in the stringed musical instrument tuning device 120 is configured to accept user input. In some embodiments, the user interface 245 depicted in FIG. 9L may be configured with a touch-sensitive display screen adapted to transform human tactile actions incident on the touch sensitive display screen to electronic signals communicatively coupled to the processor 205, depicted in FIG. 2. In the depicted embodiment, the Main screen 953 welcomes the user and displays the main device application name Roadie 2. In the illustrated embodiment, the Add Instrument screen 959 enables the user to add a new instrument to the stringed musical instrument tuning device 120 instrument configuration. In the depicted embodiment, the Instrument Type Selection screen 965 enables the user to select from various Instrument types, including, for example, Acoustic Guitar, Electric Guitar, or Ukulele. In the depicted embodiment, the Number of Strings screen 969 enables the user to choose the number of musical instrument strings, including, for example, 6 Strings, or 7 Strings. In the illustrated embodiment, the Name Configuration screen 955 enables the user to configure a name for their instrument. In the depicted embodiment, the Instrument Selection screen 961 enables the user to select from a list of instruments previously configured by the user. In the illustrated embodiment, the Tuning Parameters screen 967 enables the user to select from various strings to tune, including, for example, E2, A2, or D3, and indicates which string is currently being tuned. In the illustrated embodiment, the Tuning Control Screen 963 enables the user to Change Tuning, configure Capo parameters, or delete an instrument from the configuration. In the depicted embodiment, the Device Control screen 971 enables the user to activate various stringed musical instrument tuning device 120 features, including, for example, add New Instrument, Wind/Unwind, or Settings. In the depicted embodiment, the Wind/Unwind Control screen 957 enables the user to activate the string winding and unwinding functions of the stringed musical instrument tuning device 120.

Although various embodiments have been described with reference to the Figures, other embodiments are possible. For example, some embodiments may be a standalone automatic tuning device adapted to automatically tune a stringed musical instrument. In some embodiments, the automatic tuning device may be multi-purpose and may be used as a string winder as well as string doctor informing users of the quality of their strings. In some examples, the automatic tuning device may have different embodiments, for example the automatic tuning device may be handheld, or connected to the instrument head-stock. In some embodiments, the automatic tuning device contains an actuator that would rotate the pegs of the instrument. In various examples, the automatic tuning device actuator may be a DC motor.

In some embodiments, the automatic tuning device may include means to detect the instrument sound via audio signal vibration propagated through the headstock, the tuning peg and the automatic tuning device's enclosure. In various implementations, the sensors used to detect this vibration may be any of the following: piezoelectric sensor, accelerometer, or microphone. In some exemplary scenarios of use, a benefit of using a vibration sensor is that external sound/noise is negligible compared to the string sound, hence only the string sound can be detected. In some examples, the detected signal goes through a signal processing algorithm that suppresses unwanted sounds (such as the sound of the actuator, or external noise) and detects the frequency of the string that needs to be tuned. In various designs, the frequency may be compared to a desired set frequency of the string that needs tuning, and a processor sends control commands to rotate the peg of the guitar.

In some embodiments, the automatic tuning device may include an interface (screen, buttons, knob) so the user can: setup a profile for their instruments/providing information about the type/brand of strings used as well as instrument maintenance information; select alternate tuning; create custom tunings (by selecting the fundamental frequency of each string); change A440 reference pitch, change temperament, among other things. In various designs, the automatic tuning device can connect wireless (Bluetooth, Wi-Fi, and other wireless interface technologies as known in the art) to a cloud-based server and to a mobile application and the user can set up all the above-mentioned information using a mobile app or a web interface and they will be synchronized automatically with the device. In some embodiments, by measuring the relationship between the rotation of the peg and the frequency, the automatic tuning device builds a model of the strings/instrument being tuned. In various examples, using this model as well as information provided to us by the user, and tuning history information the automatic tuning device can keep track of the quality of the string and would inform the user when it is time to restring. In various designs, the automatic tuning device tuning algorithms may fuse information from multiple sensors and may use information from the string model to perform accurate and consistent tuning. In various implementations, the automatic tuning device includes anomaly detection algorithms that allows it to take proper action or warn the user in case the following anomalies have been detected before risking snapping a string: the user placed the device on the wrong tuning peg; the user plucked the wrong string; or, the string is wound on the peg in the opposite direction (clockwise rotation of the peg would increase the tension on the string vs the normal operation where a CCW (Counter-clockwise) rotation would actually increase the tension), among other anomalies.

In some scenarios, using a non-contact microphone (a microphone that relies on air pressure as medium for sound propagation like condenser or dynamic microphone,) may detect external noise. In some examples, using a vibration sensor that would detect the vibration of the material and connecting this sensor to the surface of the tuner, may detect only the sound of the instrument being tuned. In some embodiments, the automatic tuning device may use a piezo-electric sensor. In some examples, this piezoelectric sensor may also be a type of microphone called contact micro-phone. In some embodiments, the automatic tuning device uses this piezoelectric sensor and allowing the vibration to propagate from the instrument body to the headstock to the tuner via the tuning pegs.

In some examples, the automatic tuning device may process the captured signal to remove an undesired signal, which may include adapting a filter to remove background noise, actuator noise, or nearby musical instruments.) In some examples, the automatic tuning device may employ a piezoelectric sensor to detect audio and may also capture the sound of the actuator performing the tuning (the DC motor). In some embodiments, the automatic tuning device may run filtering algorithms to suppress the sound of the actuator performing the tuning.

In some embodiments, the automatic tuning device may model musical instruments and strings based on captured historical sensor and actuator data representative of the relationship between tuning peg rotation and measured string frequency. In some designs, the automatic tuning device may model musical instruments and strings in two stages: (1) when an instrument profile is created on the tuner, the user may be prompted to calibrate every string of his instrument so the relation between tuning peg rotation and string frequency can be modeled for each string; (2) When performing the tuning, this model gets updated and improved. In various embodiments, the automatic tuning device may use models of musical instruments and strings in the tuning process; for example, knowing that in some scenarios, the audio processing algorithm is slow and updates at a rate close to 4 Hz and also audio is not always available (it is only available when the user plucks the string) the tuning controller may use this model to predict the frequency of the string when no audio is being detected. In some designs, the prediction gets corrected when accurate audio has been measured, based on common sensor fusion algorithms such as the Kalman Filter.

In some embodiments, the automatic tuning device may build a string model used to predict string frequency based on tension even when there is no sampled vibration and a frequency measurement is not available. In some examples, the automatic tuning device may model the relationship of the tuning peg rotation to the fundamental frequency of the string; In some embodiments, the automatic tuning device may model the relationship between string tension and tuning peg rotation. In some designs, the automatic tuning device may estimate the elasticity of the string determined as a function of one or more modeled relationship between two or more of: tuning peg rotation; string tension; or, string frequency. In some designs, the automatic tuning device may identify one or more dead zone' in a string tuning, wherein modeled predicted frequency deviates from measured frequency by a predetermined threshold, at a reference tension. In some embodiments, the automatic tuning device may store presets for different string types, or custom alternative tunings, for example to solve intonation problems, or customize temperament (distribution of frequency among strings.) In some embodiments, the actuator sound may vary with the actuator torque, and the filter may be adapted in real time to remove the actuator sound. In various designs, the actuator sound may be modeled in relation to frequency, which may be a function of the actuator motor current.

According to an embodiment of the present invention, the system and method are accomplished through the use of one or more computing devices. As depicted, for example, in FIG. 1 and FIG. 2, one of ordinary skill in the art would appreciate that an exemplary stringed musical instrument tuning system appropriate for use with embodiments in accordance with the present application may generally be comprised of one or more of a Central processing Unit (CPU), Random Access Memory (RAM), a storage medium (e.g., hard disk drive, solid state drive, flash memory, cloud storage), an operating system (OS), one or more application software, a display element, one or more communications means, or one or more input/output devices/means. Examples of computing devices usable with embodiments of the present invention include, but are not limited to, proprietary computing devices, personal computers, mobile computing devices, tablet PCs, mini-PCs, servers or any combination thereof. The term computing device may also describe two or more computing devices communicatively linked in a manner as to distribute and share one or more resources, such as clustered computing devices and server banks/farms. One of ordinary skill in the art would understand that any number of computing devices could be used, and embodiments of the present invention are contemplated for use with any computing device.

In various embodiments, elements described herein as coupled or connected may have an effectual relationship realizable by a direct connection or indirectly with one or more other intervening elements.

In various embodiments, communications means, data store(s), processor(s), or memory may interact with other components on the computing device, in order to effect the provisioning and display of various functionalities associated with the system and method detailed herein. One of ordinary skill in the art would appreciate that there are numerous configurations that could be utilized with embodiments of the present invention, and embodiments of the present invention are contemplated for use with any appropriate configuration.

According to an embodiment of the present invention, the communications means of the system may be, for instance, any means for communicating data over one or more networks or to one or more peripheral devices attached to the system. Appropriate communications means may include, but are not limited to, circuitry and control systems for providing wireless connections, wired connections, cellular connections, data port connections, Bluetooth connections, or any combination thereof. One of ordinary skill in the art would appreciate that there are numerous communications means that may be utilized with embodiments of the present invention, and embodiments of the present invention are contemplated for use with any communications means.

Throughout this disclosure and elsewhere, block diagrams and flowchart illustrations depict methods, apparatuses (i.e., systems), and computer program products. Each element of the block diagrams and flowchart illustrations, as well as each respective combination of elements in the block diagrams and flowchart illustrations, illustrates a function of the methods, apparatuses, and computer program products. Any and all such functions ("depicted functions") can be implemented by computer program instructions; by special-purpose, hardware-based computer systems; by combinations of special purpose hardware and computer instructions; by combinations of general purpose hardware and computer instructions; and so on—any and all of which may be generally referred to herein as a "circuit," "module," or "system."

While the foregoing drawings and description set forth functional aspects of the disclosed systems, no particular arrangement of software for implementing these functional aspects should be inferred from these descriptions unless explicitly stated or otherwise clear from the context.

Each element in flowchart illustrations may depict a step, or group of steps, of a computer-implemented method. Further, each step may contain one or more sub-steps. For the purpose of illustration, these steps (as well as any and all other steps identified and described above) are presented in order. It will be understood that an embodiment can contain an alternate order of the steps adapted to a particular application of a technique disclosed herein. All such variations and modifications are intended to fall within the scope of this disclosure. The depiction and description of steps in any particular order is not intended to exclude embodiments having the steps in a different order, unless required by a particular application, explicitly stated, or otherwise clear from the context.

Traditionally, a computer program consists of a sequence of computational instructions or program instructions. It will be appreciated that a programmable apparatus (i.e., computing device) can receive such a computer program and, by processing the computational instructions thereof, produce a further technical effect.

A programmable apparatus may include one or more microprocessors, microcontrollers, embedded microcontrollers, programmable digital signal processors, programmable devices, programmable gate arrays, programmable array logic, memory devices, application specific integrated circuits, or the like, which can be suitably employed or configured to process computer program instructions, execute computer logic, store computer data, and so on. Throughout this disclosure and elsewhere a computer can include any and all suitable combinations of at least one general purpose computer, special-purpose computer, programmable data processing apparatus, processor, processor architecture, and so on.

It will be understood that a computer can include a computer-readable storage medium and that this medium may be internal or external, removable and replaceable, or fixed. It will also be understood that a computer can include a Basic Input/Output System (BIOS), firmware, an operating system, a database, or the like that can include, interface with, or support the software and hardware described herein.

Embodiments of the system as described herein are not limited to applications involving conventional computer programs or programmable apparatuses that run them. It is contemplated, for example, that embodiments of the invention as claimed herein could include an optical computer, quantum computer, analog computer, or the like.

Regardless of the type of computer program or computer involved, a computer program can be loaded onto a computer to produce a particular machine that can perform any and all of the depicted functions. This particular machine provides a means for carrying out any and all of the depicted functions.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Computer program instructions can be stored in a computer-readable memory capable of directing a computer or other programmable data processing apparatus to function in a particular manner. The instructions stored in the computer-readable memory constitute an article of manufacture including computer-readable instructions for implementing any and all of the depicted functions.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

The elements depicted in flowchart illustrations and block diagrams throughout the figures imply logical boundaries between the elements. However, according to software or hardware engineering practices, the depicted elements and the functions thereof may be implemented as parts of a monolithic software structure, as standalone software modules, or as modules that employ external routines, code, services, and so forth, or any combination of these. All such implementations are within the scope of the present disclosure.

Unless explicitly stated or otherwise clear from the context, the verbs "execute" and "process" are used interchangeably to indicate execute, process, interpret, compile, assemble, link, load, any and all combinations of the foregoing, or the like. Therefore, embodiments that execute or process computer program instructions, computer-executable code, or the like can suitably act upon the instructions or code in any and all of the ways just described.

The functions and operations presented herein are not inherently related to any particular computer or other apparatus. Various general-purpose systems may also be used with programs in accordance with the teachings herein, or it may prove convenient to construct more specialized apparatus to perform the required method steps. The required structure for a variety of these systems will be apparent to those of skill in the art, along with equivalent variations. In addition, embodiments of the invention are not described with reference to any particular programming language. It is appreciated that a variety of programming languages may be used to implement the present teachings as described herein, and any references to specific languages are provided for disclosure of enablement and best mode of embodiments of the invention. Embodiments of the invention are well suited to a wide variety of computer network systems over numerous topologies. Within this field, the configuration and management of large networks include storage devices and computers that are communicatively coupled to dissimilar computers and storage devices over a network, such as the Internet.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

In the present disclosure, various features are described as being optional, for example, through the use of the verb "may;", or, through the use of, for example, any of the phrases: "in some embodiments," "in some implementations," "in some designs," "in various embodiments," "in various implementations,", "in various designs," "in an illustrative example," or, "for example;" or, through the use of parentheses. For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be embodied in seven different ways, namely with just one of the three possible features, with any two of the three possible features or with all three of the three possible features.

In the present disclosure, the term "any" may be understood as designating any number of the respective elements, i.e. as designating one, at least one, at least two, each or all of the respective elements. Similarly, the term "any" may be understood as designating any collection(s) of the respective elements, i.e. as designating one or more collections of the respective elements, a collection comprising one, at least one, at least two, each or all of the respective elements. The respective collections need not comprise the same number of elements.

In the present disclosure, variable names or other identification may be given to identify storage elements to facilitate discussion, and such variable names should not be understood as limiting or restrictive unless the person skilled in the art would in some case of such a variable name or other identification recognize such non-limiting or non-restricted understanding as nonsensical.

In the present disclosure, expressions in parentheses may be understood as being optional. As used in the present disclosure, quotation marks may emphasize that the expression in quotation marks may also be understood in a figurative sense. As used in the present disclosure, quotation marks may identify a particular expression under discussion.

Any element in a claim herein that does not explicitly state "means for" performing a specified function, or "step for" performing a specific function, is not to be interpreted as a "means" or "step" clause as specified in 35 U.S.C. § 112 ¶6. Specifically, any use of "step of" in the claims herein is not intended to invoke the provisions of 35 U.S.C. § 112 ¶6.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. An apparatus, comprising:

a stringed musical instrument tuning device configured to adjust tension of a musical instrument string with a dynamic string tension adapting action rotationally applied to a tuning peg, the stringed musical instrument tuning device comprising:

an actuator, adapted to releasably couple with a musical instrument tuning peg and radially displace the tuning peg about the tuning peg longitudinal axis of rotation;

a sensor system, adapted to receive and transduce to electronic form a signal package comprising: a sound signal emitted by the musical instrument string; and, an undesired noise signal;

an internal string model configured to represent string physical properties comprising a relationship between turning peg radial displacement and frequency; and, a controller, comprising:

a processor, operably coupled with the actuator, and communicatively coupled with the sensor system; and, a memory that is not a transitory propagating signal, the memory connected to the processor and encoding computer readable instructions, including processor executable program instructions, the computer readable instructions accessible to the processor, wherein the processor executable program instructions, when executed by the processor, cause the processor to perform operations comprising:

receive the signal package from the sensor system;

configure a noise removal filter to remove the undesired noise signal from the signal package;

recover an approximation of the sound signal based on applying the noise removal filter to substantially remove the undesired noise signal from the signal package;

activate the actuator to apply corrective tuning peg radial displacement calculated as a function of the recovered sound signal approximation frequency measured by the processor, to tune the string to a predetermined reference frequency; and, automatically tune the musical instrument based on removing the undesired noise signal while activating the actuator to adjust the musical instrument string tension, until the fundamental frequency of the musical instrument string is within a predetermined tolerance of the reference frequency.

2. The apparatus of claim 1, wherein the sensor system further comprises a contact sensor.

3. The apparatus of claim 1, wherein the sensor system further comprises a non-contact sensor.

4. The apparatus of claim 1, wherein the sensor system further comprises a sensor adapted to transduce a signal propagated through the musical instrument body.

5. The apparatus of claim 1, wherein the sensor system further comprises a sensor adapted to transduce a signal propagated through the air.

6. The apparatus of claim 1, wherein the undesired noise signal further comprises actuator vibration.

7. The apparatus of claim 1, wherein the operations performed by the processor further comprise configuring the noise removal filter to remove actuator vibration determined as a function of actuator torque.

8. The apparatus of claim 1, wherein the stringed musical instrument tuning device further comprises a user interface configured to allow the user to perform a tuning device operation selected from the group consisting of create and delete instrument profiles, select an instrument to tune from the list of instrument profiles, choose to tune in standard or from a list of alternate tunings, create custom tunings, change the reference A 440 Hz pitch to different values, select the position of a capo for tuning while a capo is attached to the instrument, display the firmware version, display the battery charge left, run a diagnostics routine to the apparatus, and indicate tuning results and status to the user.

9. The apparatus of claim 1, wherein the tuning device further comprises a user interface that displays to the user their tuning habits and informs them of the history and trends of their tunings.

10. The apparatus of claim 1, wherein the tuning device further comprises wireless communication capability allowing mobile phones, tablets, laptops, computers, smartwatches, home automation devices, smart speakers, or voice-controlled intelligent personal assistants to be used as user interfaces that control the device and convey information back to the user.

11. The apparatus of claim 10, wherein the tuning device further comprises configuration to enable users to share tunings and information about their instruments with other users via a cloud and an interface on the tuning device, mobile phone, tablet, laptop, computer, smartwatch, home automation device, smart speaker, or voice-controlled intelligent personal assistant.

12. The apparatus of claim 1, wherein the tuning device further comprises wireless communication capabilities that allow it to transfer and backup all or a portion of the data stored on a cloud.

13. The apparatus of claim 1, wherein the operations performed by the processor further comprise determining parameters of the internal string model based on a calibration procedure performed by the processor.

14. The apparatus of claim 1, wherein the operations performed by the processor further comprise improving and adapting the internal string model based on string data collected by the processor while tuning a string.

15. The apparatus of claim 1, wherein the controller adaptively controls the actuator depending on the internal string model, to provide a consistent response independent of the type of instrument, string, or tuning pegs installed.

16. The apparatus of claim 1, wherein the operations performed by the processor further comprise identifying string quality and assessing whether a string needs replacement based on string quality evaluation determined as a function of string elasticity variation, computed from the variation in the internal string model.

17. The apparatus of claim 1, wherein the operations performed by the processor further comprise predicting the string's measured pitch frequency as a function of the internal string model and the string's tuning peg rotation measured by the processor.

18. The apparatus of claim 17, wherein the operations performed by the processor further comprise correcting the predicted pitch frequency using signal processing applied on the sound signal in response to sound signal detection by the processor.

19. The apparatus of claim 1, wherein the operations performed by the processor further comprise identifying string quality and assessing whether a string needs replacement based on tuning quality and usage history of the string.

20. The apparatus of claim 1, wherein the operations performed by the processor further comprise informing the user that it is time to change their strings.

21. The apparatus of claim 20, wherein the operations performed by the processor further comprise suggesting the type of strings to use and brand based on their tuning habits and history.

22. The apparatus of claim 1, wherein the operations performed by the processor further comprise detecting anomalies in the tuning to improve tuning quality by increasing at least one of speed or accuracy of the tuning.

23. The apparatus of claim 1, wherein the operations performed by the processor further comprise adapting the tuning device to be a string winder and unwinder useful for changing instrument strings.

24. The apparatus of claim 1, wherein the tuning device is handheld.

25. The apparatus of claim 1, wherein the tuning device is continuously attached with an instrument being tuned.

26. The apparatus of claim 1, wherein the tuning device is removably attachable with an instrument being tuned.

27. The apparatus of claim 1, wherein the tuning device further comprises communicative coupling of the processor with the internet and the operations performed by the processor further comprise updating via the internet the tuning device firmware, including the instructions to the processor stored on the device's memory.

28. The apparatus of claim 1, wherein the operations performed by the processor further comprise invoking tuning device functions operated in response to voice commands received by the processor.

29. The apparatus of claim 1, wherein the tuning device further comprises an interface including a knob and button configured to allow the user to scroll through menus and make selections on the screen.

30. An apparatus, comprising:

a stringed musical instrument tuning device configured to adjust tension of a musical instrument string with a dynamic string tension adapting action rotationally applied to a tuning peg, the stringed musical instrument tuning device comprising:

an actuator, adapted to releasably couple with a musical instrument tuning peg and radially displace the tuning peg about the tuning peg longitudinal axis of rotation;

a sensor system, adapted to receive and transduce to electronic form a signal package comprising: a sound signal emitted by the musical instrument string; and, an undesired noise signal; and, a controller, comprising:

a processor, operably coupled with the actuator, and communicatively coupled with the sensor system; and, a memory that is not a transitory propagating signal, the memory connected to the processor and encoding computer readable instructions, including processor executable program instructions, the computer readable instructions accessible to the processor, wherein the processor executable program instructions, when executed by the processor, cause the processor to perform operations comprising:

receive the signal package from the sensor system;

configure a noise removal filter to remove the undesired noise signal from the signal package;

recover an approximation of the sound signal based on applying the noise removal filter to substantially remove the undesired noise signal from the signal package;

activate the actuator to apply corrective tuning peg radial displacement calculated as a function of the recovered sound signal approximation frequency measured by the processor, to tune the string to a predetermined reference frequency;

automatically tune the musical instrument based on removing the undesired noise signal while activating the actuator to adjust the musical instrument string tension, until the fundamental frequency of the musical instrument string is within a predetermined tolerance of the reference frequency; and, measure the pitch frequency of the sound signal and take preventive actions to avoid snapping a string, when anomalies in the tuning are detected by the processor as a function of the measured pitch frequency.

31. The apparatus of claim 30, wherein the operations performed by the processor further comprise notifying the user to place the tuning device on the correct peg when the processor detects the user connected the tuning device to the wrong tuning peg or plucked a string different than the string being tuned, based on a determination by the processor that a change in the tuning peg radial displacement caused no variation in the measured pitch frequency and the measured pitch frequency is close to the reference pitch frequency.

32. The apparatus of claim 30, wherein the operations performed by the processor further comprise modifying one or more parameters of the controller to reverse the string winding action of the actuator, in response to a determination by the processor that the string was wound in a clockwise direction on the tuning peg which is opposite to the standard used where the string should be wound in a counterclockwise direction, based on the processor detecting counterclockwise rotation of the string's tuning peg resulted in a decrease instead of an increase in the measured pitch frequency.

33. An apparatus, comprising:

a stringed musical instrument tuning device configured to adjust tension of a musical instrument string with a dynamic string tension adapting action rotationally applied to a tuning peg, the stringed musical instrument tuning device comprising:

an actuator, adapted to releasably couple with a musical instrument tuning peg and radially displace the tuning peg about the tuning peg longitudinal axis of rotation;

a sensor system, adapted to receive and transduce to electronic form a signal package comprising: a sound signal emitted by the musical instrument string; and, an undesired noise signal; and, a controller, comprising:

a processor, operably coupled with the actuator, and communicatively coupled with the sensor system; sensor fusion; and, a memory that is not a transitory propagating signal, the memory connected to the processor and encoding computer readable instructions, including processor executable program instructions, the computer readable instructions accessible to the processor, wherein the processor executable program instructions, when executed by the processor, cause the processor to perform operations comprising:

receive the signal package from the sensor system;

configure a noise removal filter to remove the undesired noise signal from the signal package;

recover an approximation of the sound signal based on applying the noise removal filter to substantially remove the undesired noise signal from the signal package;

activate the actuator to apply corrective tuning peg radial displacement calculated as a function of the recovered sound signal approximation frequency measured by the processor, to tune the string to a predetermined reference frequency;

automatically tune the musical instrument based on removing the undesired noise signal while activating the actuator to adjust the musical instrument string tension, until the fundamental frequency of the musical instrument string is within a predetermined tolerance of the reference frequency; and, adaptively control the actuator as a sensor fusion function of more than one signal received from the sensor system.

34. The apparatus of claim 33, wherein the controller is further adapted to measure actuator torque as a function of sensing actuator current and the operations performed by the processor further comprise adaptively controlling the actuator as a function of actuator current.

35. The apparatus of claim 33, wherein the operations performed by the processor further comprise counting rotations of the tuning peg via the actuator as an additional signal input for the sensor fusion function.

* * * * *